US005909751A

United States Patent [19]

Teagno

[11] Patent Number: 5,909,751

[45] Date of Patent: Jun. 8, 1999

[54] AUTOMATIC CABLE TIE INSTALLATION TOOL

[75] Inventor: Vladimiro Teagno, Turin, Italy

[73] Assignee: Thomas & Betts International, Inc., Sparks, Nev.

[21] Appl. No.: 08/958,237

[22] Filed: Oct. 27, 1997

[30] Foreign Application Priority Data

Oct. 31, 1996 [IT] Italy ..... RM96A0746

[51] Int. Cl.[6] ..... B21F 9/02

[52] U.S. Cl. ..... 140/123.6; 140/93.2; 221/171

[58] Field of Search ..... 140/93 R, 93.2, 140/123.6; 221/156, 171, 172

[56] References Cited

U.S. PATENT DOCUMENTS

| | | |
|---|---|---|
| 3,858,722 | 1/1975 | Haas . |
| 3,891,012 | 6/1975 | Bakermans . |
| 3,946,769 | 3/1976 | Caveney et al. . |
| 3,976,108 | 8/1976 | Caveney et al. . |
| 4,004,618 | 1/1977 | Turek . |
| 4,359,070 | 11/1982 | Hidassy et al. . |
| 4,495,972 | 1/1985 | Walker . |
| 4,498,506 | 2/1985 | Moody et al. . |
| 4,550,857 | 11/1985 | Castner, Sr. et al. . |
| 4,632,247 | 12/1986 | Moody et al. . |
| 4,640,319 | 2/1987 | Walker . |
| 4,640,320 | 2/1987 | Avison et al. . |
| 4,710,351 | 12/1987 | Wogoman . |
| 4,790,225 | 12/1988 | Moody et al. . |
| 4,862,928 | 9/1989 | Caveney et al. . |
| 5,065,798 | 11/1991 | Alletto et al. . |
| 5,144,989 | 9/1992 | Mika et al. . |
| 5,205,328 | 4/1993 | Johnson et al. . |
| 5,386,856 | 2/1995 | Moody et al. . |
| 5,417,252 | 5/1995 | Kurmis . |
| 5,417,253 | 5/1995 | Kurmis . |
| 5,417,254 | 5/1995 | Kurmis . |
| 5,429,158 | 7/1995 | Kurmis . |
| 5,595,220 | 1/1997 | Leban et al. . |

FOREIGN PATENT DOCUMENTS

| | | |
|---|---|---|
| 521 199 | 1/1993 | European Pat. Off. . |
| 9015487 | 1/1991 | Germany . |

*Primary Examiner*—Lowell A. Larson
*Attorney, Agent, or Firm*—Hoffmann & Baron, LLP

[57] ABSTRACT

An automatic cable tie installation tool includes a frame supporting a handle and a manual trigger. A movable jaw is provided to grasp a bundle of cables which are to be tied with ties straps. Actuation of the trigger operates the jaw to move the jaw into engagement with the bundle of cables. The tool provides for accommodation of a symmetrical cable tie strap and also provides for the orientation of the cable tie strap so that the strap can be properly bundled around the group of cables supported within the jaw. The tool provides for proper tensioning of the cable tie around the bundle of cables and for repeated application of cable ties around the bundle of cables within a short period of time.

23 Claims, 22 Drawing Sheets

AUTOMATIC CABLE TIE INSTALLATION TOOL

BACKGROUND OF THE INVENTION

The present invention relates to the field of binding a bundle of wires or cables or the like by means of a self-locking cable tie having an apertured head including a movable pawl cooperating with a tail part having a toothed structure.

More in particular the present invention relates to a tool for installing and fastening a cable tie strap in an automatic way, wherein the tool is powered by means of compressed air, and tie straps are automatically delivered to the installation tool by means of a flow of compressed air from an automatic dispenser at each operation of the installation tool.

Automatic cable tie installation tools comprising means for grasping a bundle of cables or the like, and including means for propelling a tie strap along a closed path around the grasped bundle of cables or the like, and means for tightening the tie strap around the bundle of cables and for cutting an excess part of the tail of a tie strap are known in the art.

Examples of automatic cable tie installation tools according to the art are disclosed for example in U.S. Pat. No. 3,946,769 issued on Mar. 30, 1976 and assigned to Panduit Corporation, USA; U.S. Pat. No. 3,515,178 issued on Jun. 2, 1970 and assigned to Thomas & Betts Corporation, USA; U.S. Pat. No. 5,205,328 issued on Apr. 27, 1993 and assigned to Panduit Corp., USA, and others.

The problem of lacing bundles of wires or cables or the like has been recognized for a long time in the electrical and electronics industry.

Prior to the advent of cable tie straps of the above mentioned kind, the lacing of cables or the like was performed by hand with lacing cords, lacing spirals, etc. The introduction several years ago of tie straps having an apertured head and a toothed tail arranged to engage a retaining pawl provided in the aperture of the apertured head has contributed to alleviate the production costs, and concurrently with the development of cable tie straps of the concerned kind, installation tools have been developed to further increase the productivity of an operator and to further reduce the consequent costs.

A consideration of automatic cable tie installation tools as it results, among others, from the specification of the above-identified patents makes clear that there are still many problems that leave open the way to improvements both in the tie straps themselves and in the automatic cable tie installation tools.

A first problem lies in the fact that the tie straps of the kind in question for use in automatic tools have an asymmetrical structure that leads to problems in propelling a tie strap towards the installation mechanisms that are particularly serious when a separate tie strap dispenser has to cooperate with the installation tool because the correct orientation must be maintained along a propulsion conduit leading from a dispenser to the installation tool.

Symmetrical tie straps are now disclosed in U.S. patent application Ser. No. 08/689,466, filed on Aug. 6, 1996, entitled: "A SELF LOCKING CABLE TIE STRAP WITH SYMMETRICAL STRUCTURE".

Although these tie straps facilitate orientation of the tail with respect to the head, automatic installation tools that take advantage of the improved cable tie straps mentioned above are not known.

Other problems are connected with the personal safety or an operator when using automatic installation tools that customarily have power actuated jaws for positioning and installing a tie strap around a bundle of cables or the like, that can injure the fingers of a careless operator or "pinch" or even cut a wire or cable in the nip of the closing jaws, with the result that an entire bundle of cables has to be scrapped, with obvious consequences.

Another problem encountered with installation tools of the known prior art consists in the fact that for the sequential installation of straps one after the other in a long span of a bundle of wires or cables, for each installation of a strap the whole cycle has to be repeated with a consequent loss of time.

Accordingly an object of the present invention is to provide an automatic tie strap installation tool that makes it possible to overcome the inconveniences shown in tools of this kind according to the prior art.

According to the present invention there is provided an automatic cable tie installation tool, comprising:

A frame with a handle with manual trigger means.

A movable jaw for grasping a bundle of cables or the like to be tied with a tie strap.

Means interconnecting said trigger means and said jaw, for moving the jaw in engagement with said bundle of cables with the manual force of the operator.

Means that can be actuated at the end of said engagement operation for retracting said jaw to define a substantially closed path for a cable tie.

Means for "shooting" a cable tie having a random orientation towards said closed path, associated with means for braking and correctly orienting said cable tie strap before entering of the same into said closed path.

Means for pushing said cable tie along said closed path and for engaging the tail of the cable tie after the passage thereof through said apertured head so that the cable tie is tightened around the bundle of cables or the like.

Means for grasping the tail of a cable tie strap after it passes through the apertured head, so that the cable tie is tightened around the bundle of cables or the like.

Means cooperating with said third power means, to sense when a desired tightening of the cable tie has been reached, and to actuate means to drive cutting means for severing the excess of said tail of said cable tie strap.

Means for returning said first means to their rest condition in order to open and release said jaw and to reposition said second means in their rest position, ready for a new operation.

Still according to the present invention there are provided means for repeating an installation operation for a plurality of tie straps in sequence without the execution of a complete cycle, i.e. maintaining closed the movable jaw while the tool is shifted along a span of a bundle of wires or cables that requires the installation of a plurality of tie straps.

Other characteristics, features and advantages of the automatic cable tie installation tool according to the invention will become clear from the following description, given only as a non-limiting example and with reference to the attached drawings.

DETAILED DESCRIPTION OF THE PREFERRED EMBODIMENT

Figure 1:
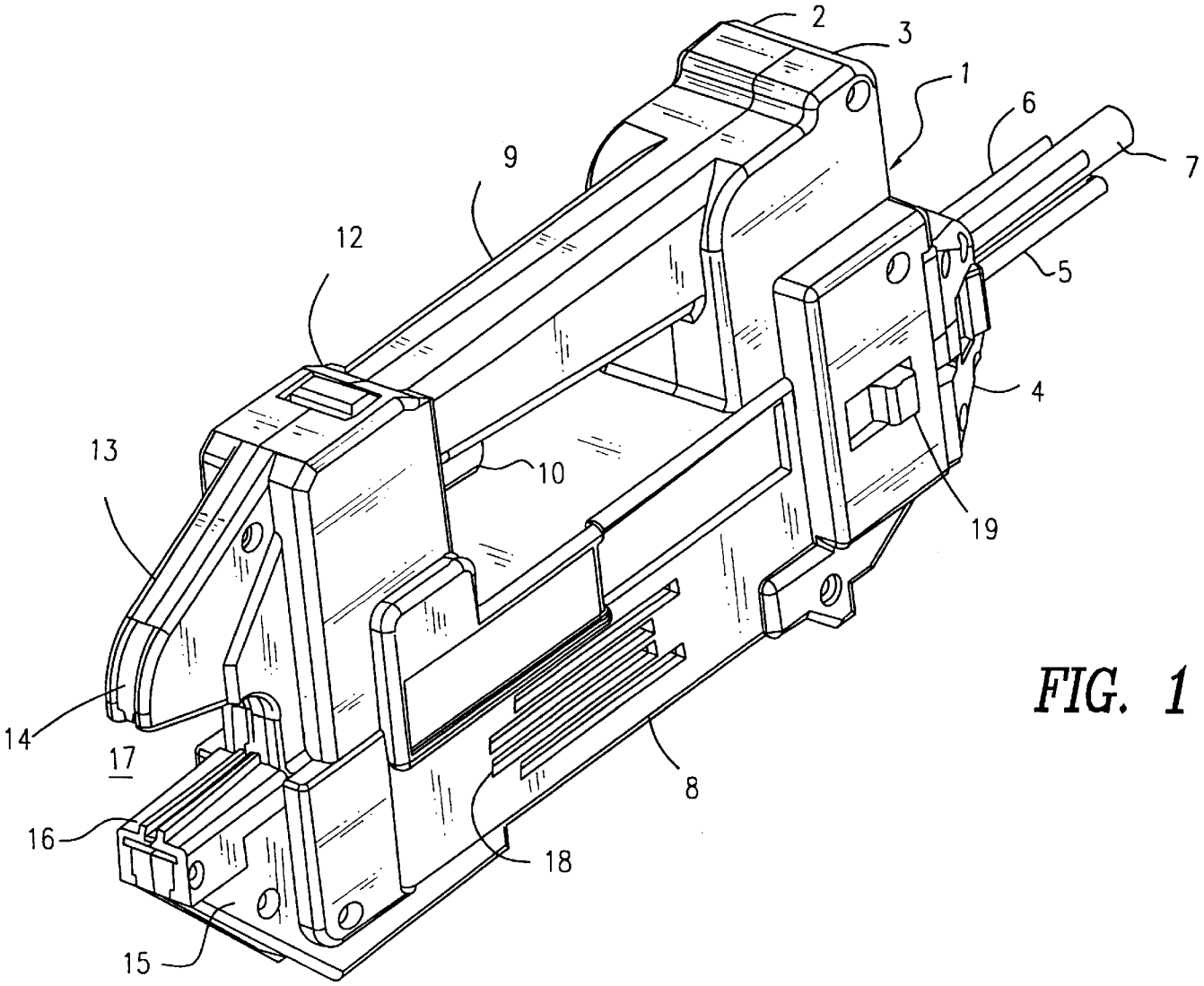
FIG. 1 is an overall perspective view of the automatic cable tie installation tool according to the present invention.
Figure 2B:
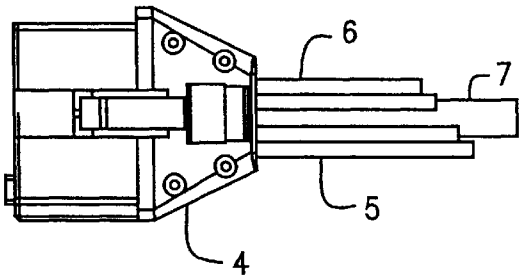
FIG. 2B is a top view of the rear end of the tool of FIG. 1 including a tubing connector.
Figure 2A:
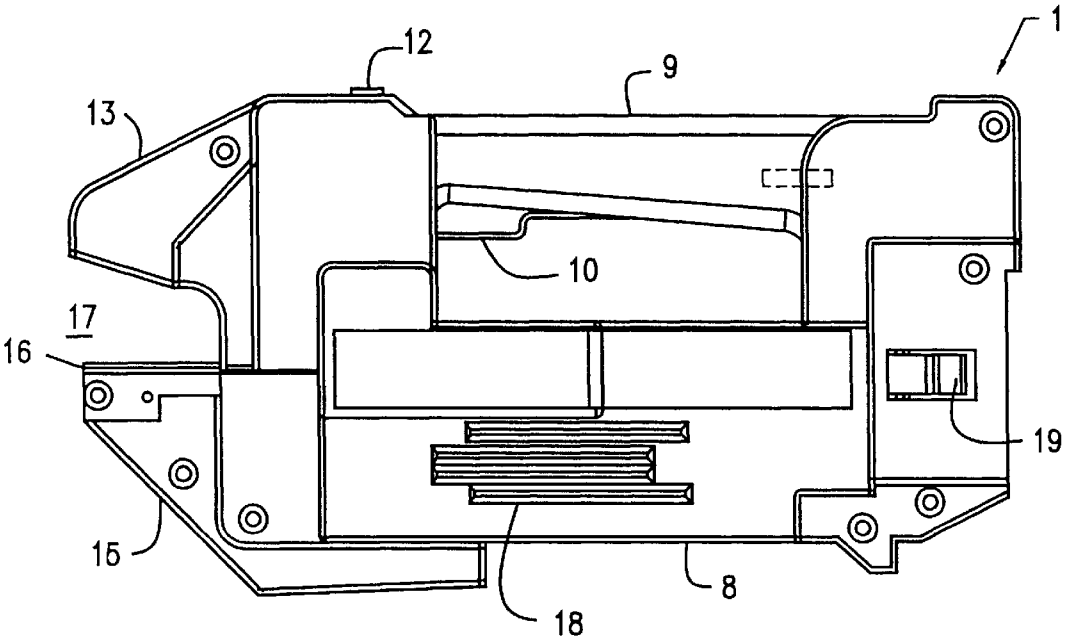
FIG. 2A is a side elevation of the tool of FIG. 1.

With reference to the drawings, in FIG. 1 there is shown an overall perspective view of the automatic cable tie installation tool 1, comprising a body constituted by two shells 2, 3 which performs the double function of external envelope of the tool and the frame supporting the internal mechanisms, as it will be shown hereinafter.

The rear end of the body 1 of the tool is arranged for holding a connector, generally shown in 4, whereon arrive several tubings 5, 6 for compressed air and a pipe 7 within which is propelled by means of compressed air a cable tie strap (not shown) with its tail directed towards the tool 1, which is supplied from a dispenser (not shown), which preferably is constructed as disclosed in a copending patent application.

Again with reference to FIG. 1, it can be seen that the body 1 is substantially divided int a lower part 8 and an upper part 9 which constituted the handle of the tool. In this way a balanced construction is obtained with the center of gravity of the same that is located below the hand of the operator, with a consequent reduction in fatigue and ease of handling even in restricted spaces.

The upper part or handle 9 carries also a trigger 10 for starting the operation of the tool, as it will be seen hereinafter.

The front of the tool 1 comprises a block 11, carrying at its top a push-button 12 for enabling a particular mode of operation, and a nose 13 housing a movable jaw 14. In register with the nose 13 there is provided a shoe 15 carrying a two-part rail piece 16 arranged to cooperate with the jaw 14. Both the nose 13 and the shoe 15 define a space 17 within which is positioned a bundle of cables of the like to be tied with a tie strap (not shown).

On both sides of the lower body 8 there are provided slots 18 for the exit of excess compressed air discharged at the interior of the tool 1.

Finally in the rear part of the tool 1 there is provided a pair of push-buttons 19 (only one visible in FIG. 1) for the quick disconnection of the connector 4 whenever necessary.

Figure 3:
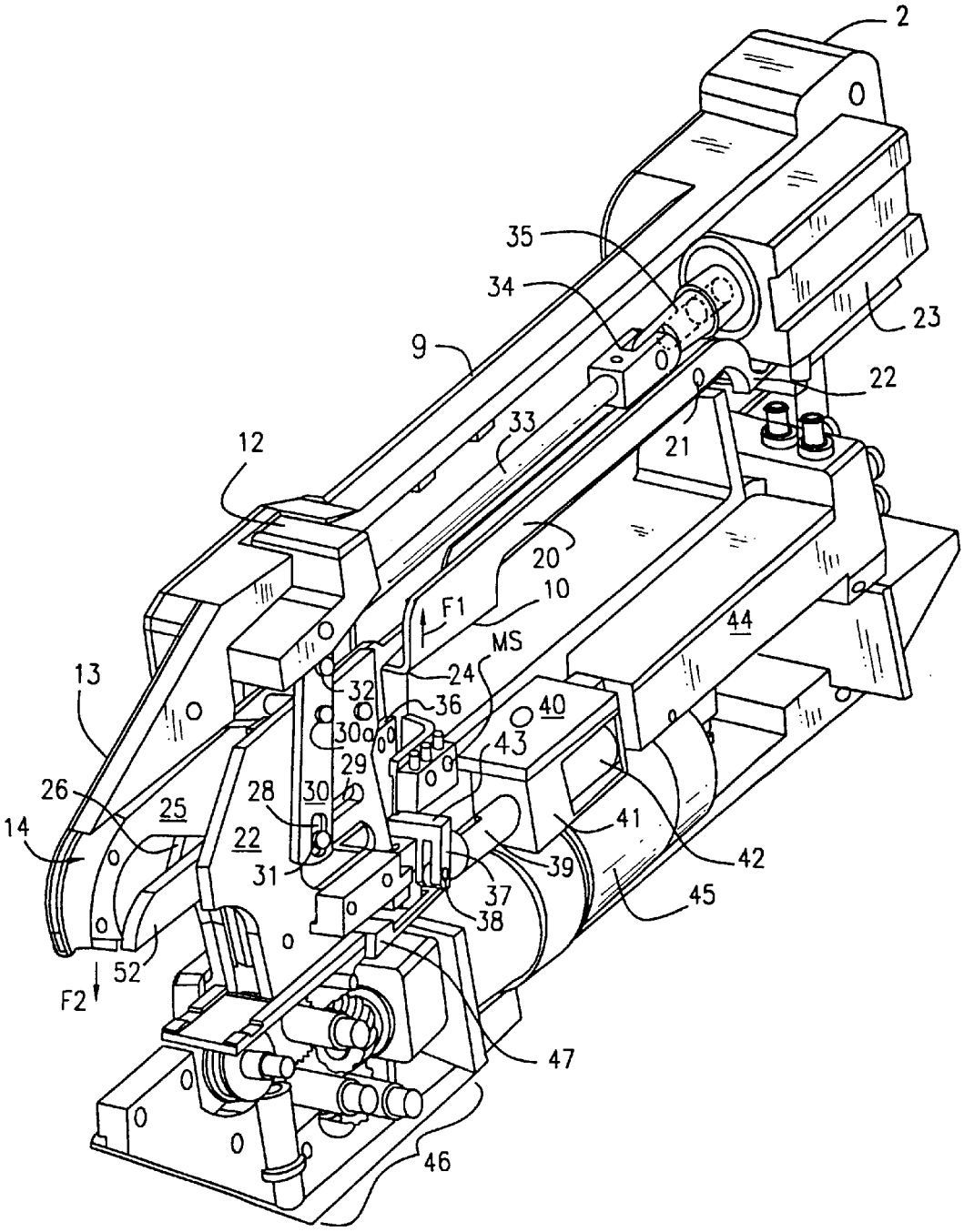
FIG. 3 is a simplified perspective view showing a general arrangement of the internal mechanisms of the cable tie installation tool.

With reference now to FIG. 3 we will begin to disclose the internal mechanisms of the automatic installation tool.

In FIG. 3 there is shown one of the two shells 2, the left part of the nose 13, the movable jaw 14, and the trigger 10.

The trigger 10, movable upwards as indicated by the arrow F1, is located at one end of a rocking arm 20, pivoted in 21 and provided with an L-shaped stop member 22 that abuts, in its rest position, against the lower part of the block of a double action air cylinder 23. When hand actuated, in the direction of the arrow F1, the trigger 10 engages a finger 24 that through a pin-and-slot mechanism (disclosed hereinafter) causes the rotation in a counterclockwise direction of the body 25 of the movable jaw 14. The body 25 of the movable jaw 24 is kept between two plates 26, 27 and can rotate around a movable pin 28 for a first rotation movement as shown by the arrow F2. (As it will be shown hereinafter the body 25 of the jaw 14 can move to the right in FIG. 3).

The pin 28 can slide along a slot 29 under the control of a rocking arm 30 pivoted in 30*a* to the plates 26, 27 having a lost motion connection by means of slot 31 with the pin 28.

The upper part of the rocking arm 30 is connected with a pin 32 with a piston shaft 33 connected with a hinge joint 34 to the actual piston rod 35 of the double-action air cylinder 23.

The finger 24 cooperating with the trigger 10 is located at the upper right end of a "T" shaped lever 36, the lower end 37 thereof is hingedly connected in 38 with the plunger 39 of a latching solenoid 40.

The latching solenoid 40 is provided with a permanent magnet 41, that cooperating with the magnetic circuit of the solenoid 40 causes the plunger 39 to be "sucked" and locked towards the interior of the solenoid 40 until an unlatching electric pulse is applied to a release coil 42.

The lower end 37 of the lever 36 is provided with a cam surface 43 arranged to cooperate with the actuation button of a microswitch MS.

Figure 4:
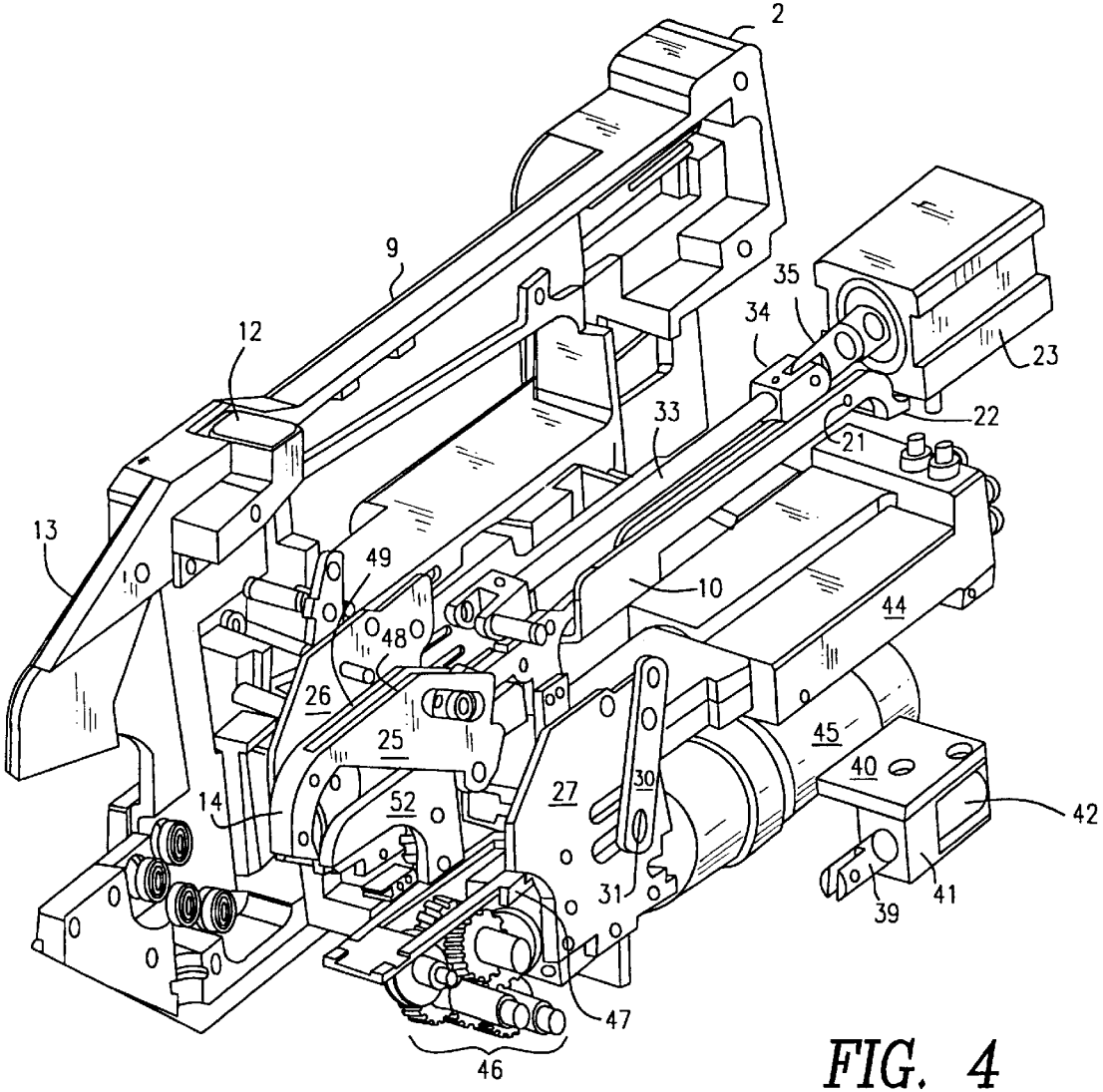
FIG. 4 is an exploded view corresponding to FIG. 3.

In FIGS. 3 and 4 there appear a number of other components: a block 44 including a second double-action air cylinder, an electric motor 45 associated to a gear train 46, a carriage 47 for a cuter blade for severing the excess part of the tail of a tightened tie strap and the mechanism for feeding, guiding and orienting a tie strap, not visible in these figures, and that will be described hereinafter.

Figure 5:
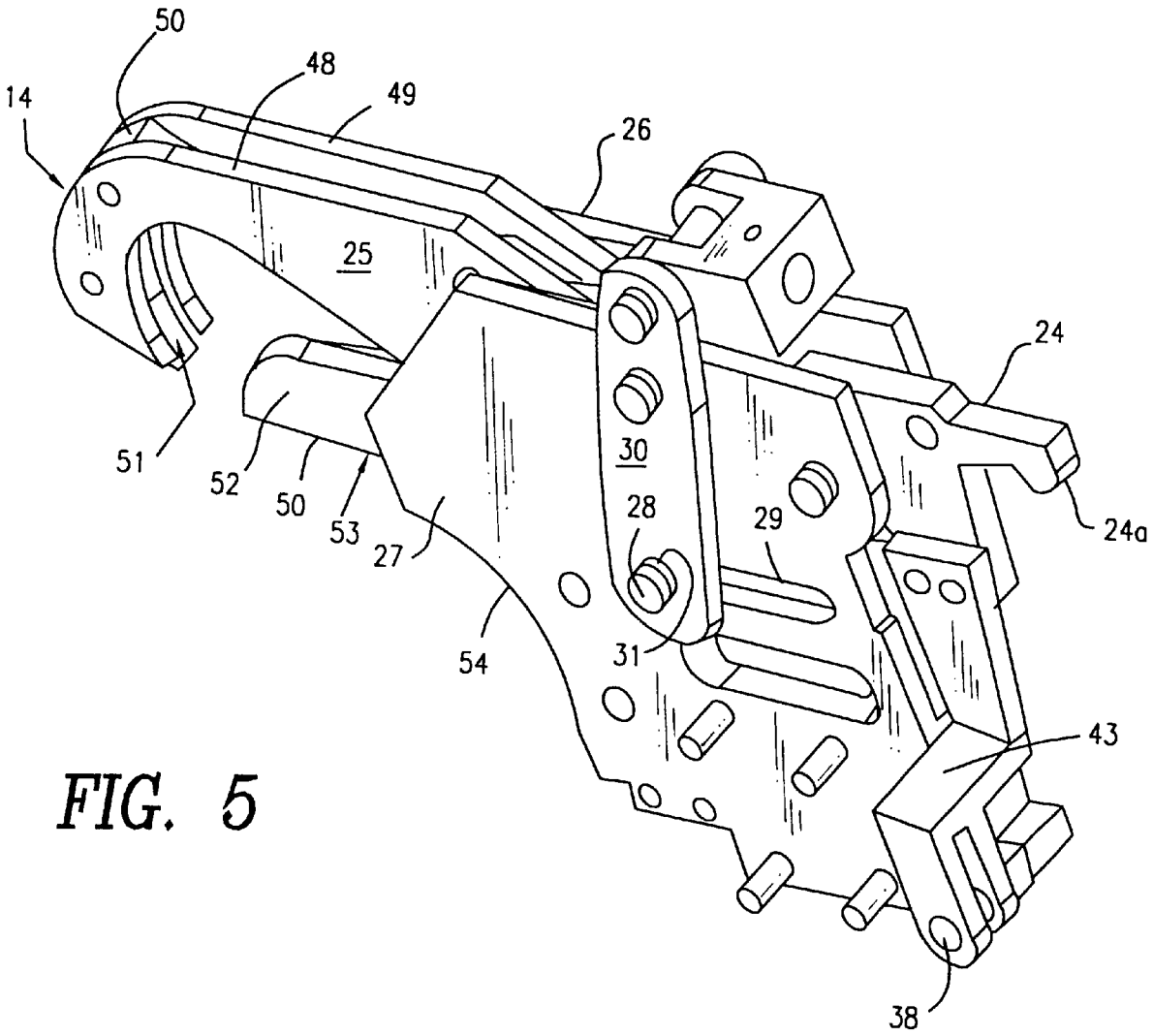
FIG. 5 is a perspective view of a part of the mechanism for moving the movable jaw of the tool.
Figure 6:
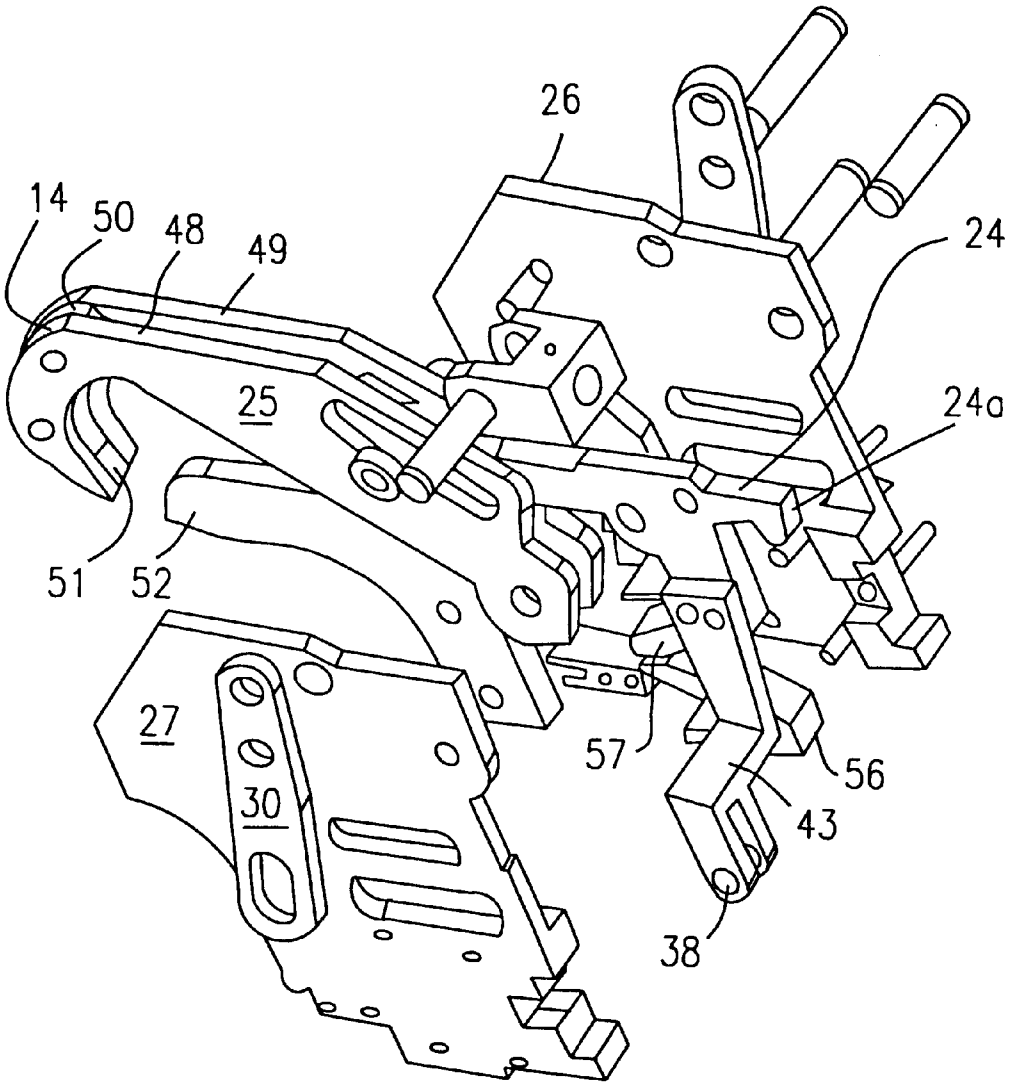
FIG. 6 is an exploded view corresponding to FIG. 5.

With reference to FIGS. 5 and 6, there is shown in more detail the sub-assembly for controlling the closure movement of the movable jaw 14. In these figures the same numbers used in FIGS. 1–4 indicate the same parts.

It can be seen that the body 27 of the hook 14 is made up of two blades 48, 49 with interposed an insert 50 in order to constitute a curved channel 51 for guiding the tail of a tie strap as we will see hereinafter. The structure comprising the plates 26, 27 holds a centering blade 52 which slides between the opposed internal surfaces of the two blades 48, 49.

The lower surface 53 of the blade 52 cooperates with the curved edges 54 (only one visible in FIGS. 5, 6) to define a further portion of a channel similar to channel 51 for the same purpose as the latter.

In the exploded view of FIG. 6 it is possible to see two "V" shaped members 56, 57 maintained in the position shown by two springs (not shown in this figure) that, as it will be seen hereinafter, serve the purpose of braking and performing the correct orientation of a tie strap propelled within the tie strap application tool.

Now with references to FIGS. 7 to 12 we will disclose the sequence of operations from the stand-by condition of the apparatus up to the completion of the binding of a cable tie strap around a bundle of cables. It is to be noted that, for the sake of clarity and to simplify the description, in FIGS. 7 to 12 only the essential parts for explaining the operation have been shown.

Figure 13:
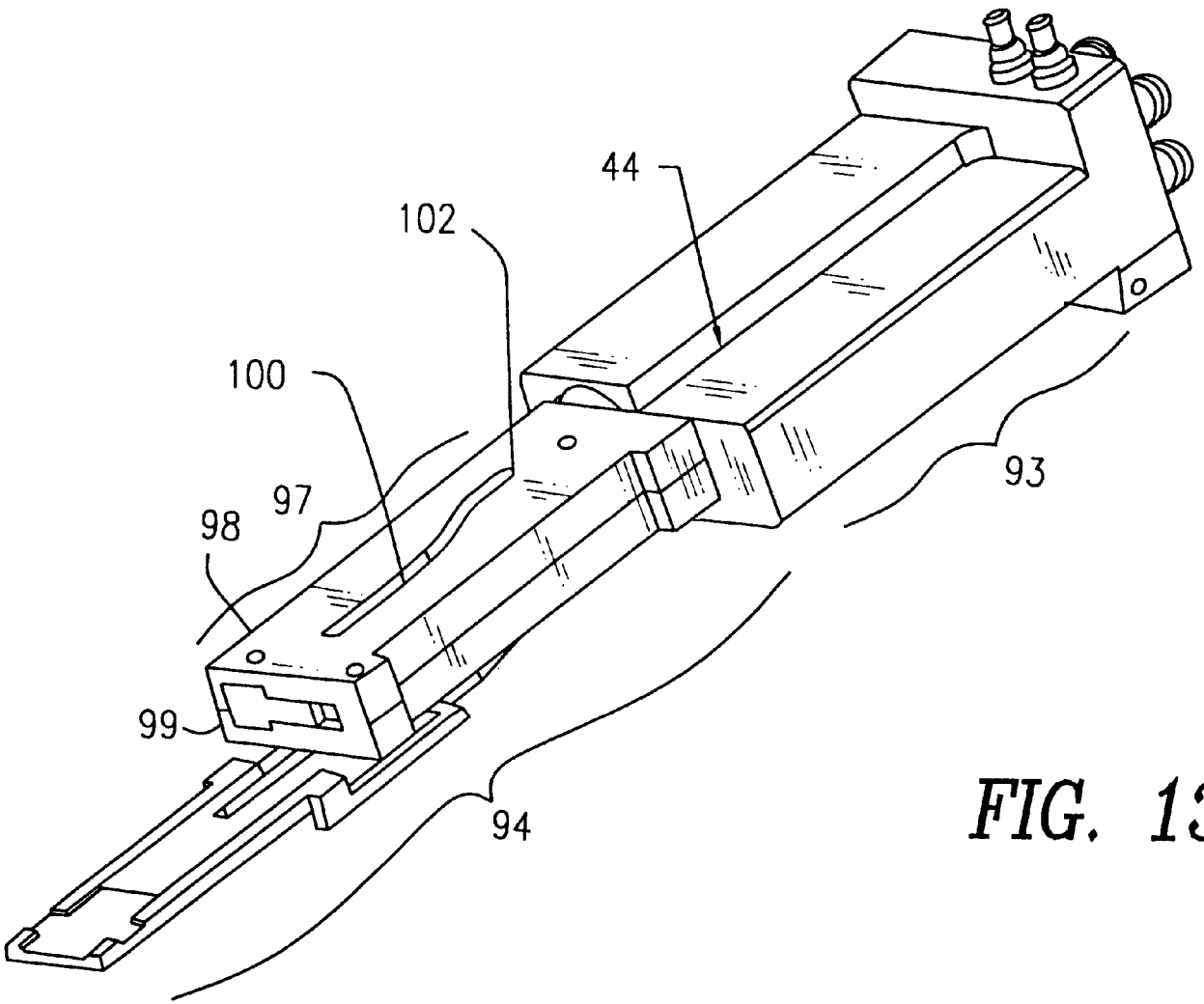
FIG. 13 shows a perspective view of a sub-assembly for positioning and actuating a pusher rod for the tie strap, and a cutter for the excess part of a tie strap after the binding of a bundle of cables.
Figure 14:
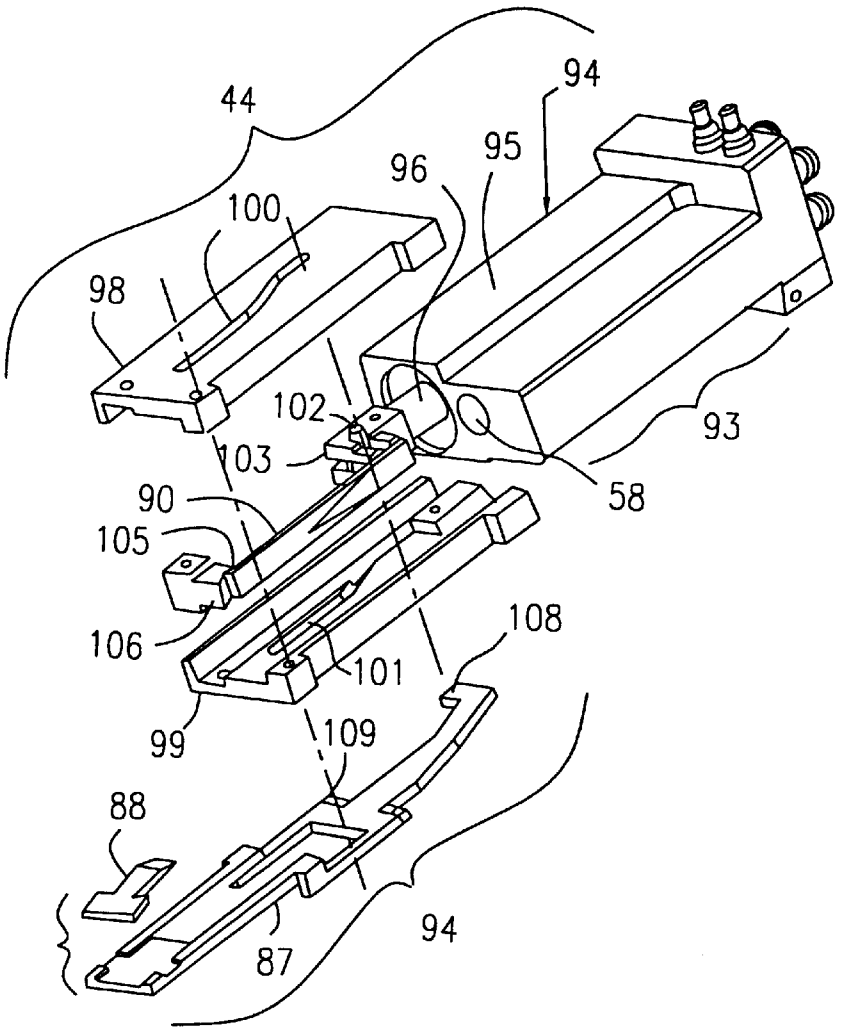
FIG. 14 shows an exploded view of parts of the sub-assembly shown in FIG. 13.

It is to be noted that the apparatus according to the invention is designed to operate with symmetrical cable tie straps as disclosed in U.S. patent application Ser. No. 08/689,466 mentioned above, the disclosure of which should be considered herein included as a reference. A preferred type of symmetrical tie strap is shown in FIGS. 13 and 14.

Figure 7:
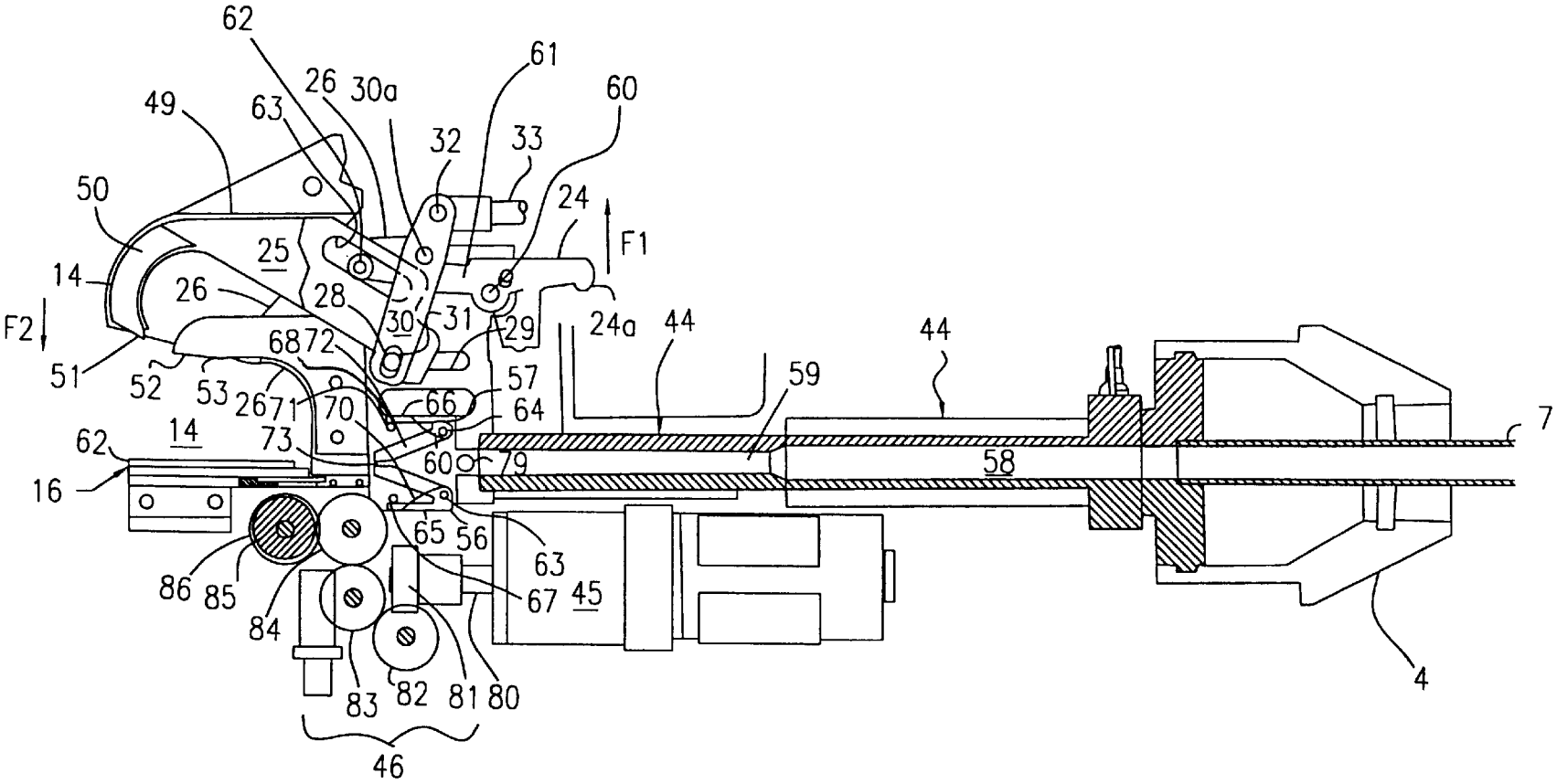
FIGS. 7, 8, 9, 10, 11, and 12 show partial elevation views, with omitted parts, showing the sequence of operations from stand-by situation up to the complete binding of a bundle of cables with a tie strap.

With reference to FIG. 7, there are shown the illustrated parts of the installation tool in the stand-by condition. The movable jaw 14 is fully open, and the mouth 14 is open leaving space for the introduction therein of a bundle of cables or the like.

Firstly it is to be noted the straight line path going from the pipe 7 fastened to the connector 4, the channels 58, 59 at the interior of the block 44, and extending through the braking and centering means 56, 57 up to the rail piece 16.

As it will be seen, a tie strap is propelled with compressed air from the right of the drawing, towards the left, in the position tail first, head last.

The nose 24*a* of the "T" shaped lever 24 pivoted at 60 is pushed upwards by means of the force of a finger of an operator by means of the trigger (not shown in this figure), causing the lever 24 to rotate counterclockwise depressing the arm 61 of the lever 24 that through the pin-and-slot coupling 62, 63 causes the counterclockwise rotation of the part 25 of the jaw 14 (arrow F2) around the pin 28 that slides along the slot 29 and the slot 31 of the rocker level 30.

The movement according to the arrow F2 of the jaw 14 continues up to when the tooth 51 engages the channel 62 in the rail piece 16.

It is to be remarked that this closure movement of the jaw 14 is driven solely by the manual force of the operator who with his fingers lifts the trigger 10 and consequently the nose 24*a* of the lever 60.

This arrangement allows to overcome a potential safety problem of these power driven tools.

Indeed, if the finger of an operator is caught between the tooth 51 and the rail piece 16 a biological reflex will prevent the operator from further acting on the trigger 10, thus avoiding any personal injury. Moreover, if a cable of the bundle is misplaced between the tooth 51 and the rail piece 16, since the linkage going from the nose part 24*a* constitutes in practice a lever of the third kind any force applied on the trigger 10 will be decreased at the tooth 51 by a ratio corresponding to the actual ratio between the arms of the leverage and consequently it is impossible to pinch or to "nick" a cable or wire caught between the tooth 51 and the rail piece 16, thus avoiding any possibility of damaging any wire or cable of the bundle to be tied.

As a matter of fact the dimensioning of the parts is such that almost at the end of the closure of the jaw 14 the camming surface 43 (see FIG. 3) that actuates the microswitch MS, operates the latter that starts the power activating of the installation tool only when the tooth 51 has at least partially engaged the channel 62 of the rail piece 16, preventing in this way any of the inconveniences above mentioned.

Figure 8:
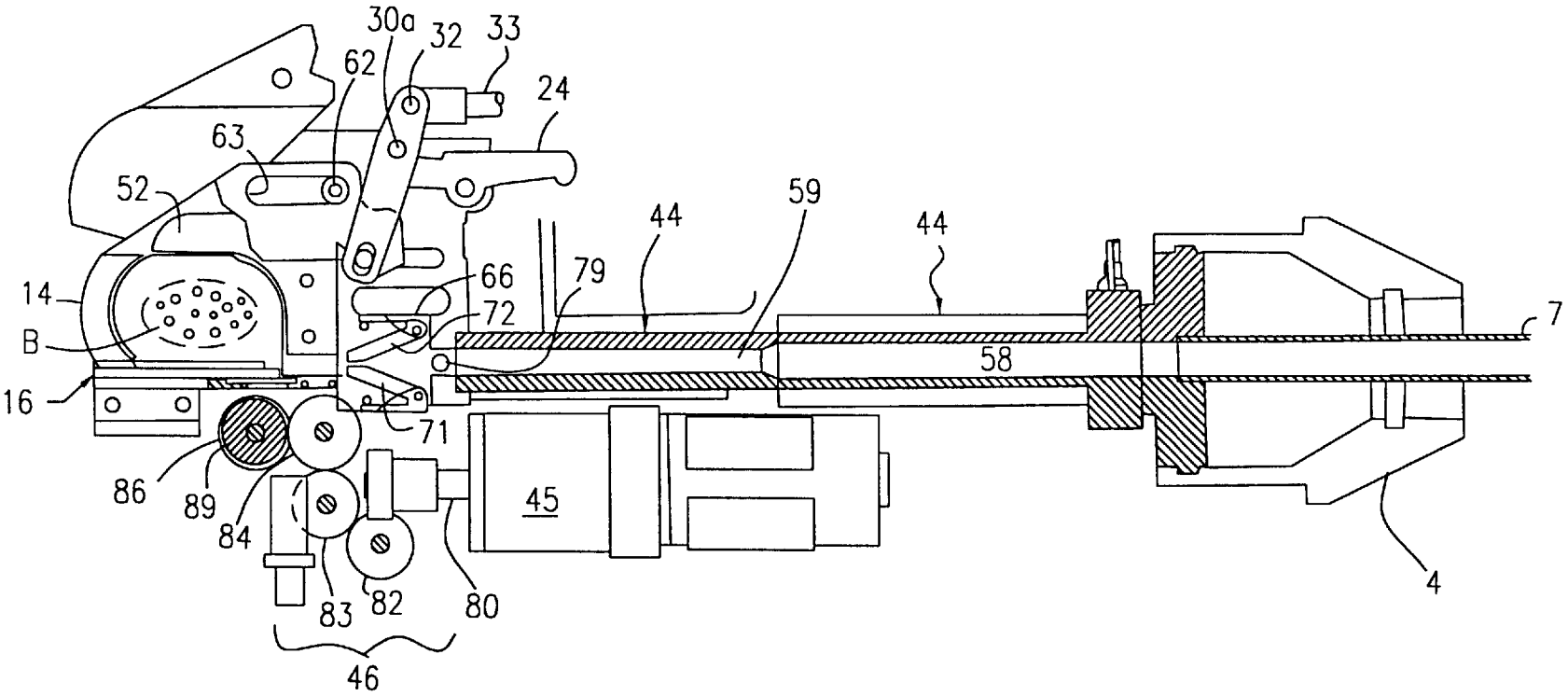

At the end of the actuation of the trigger 10 the parts of the apparatus will assume the position shown in FIG. 8 with the bundle of cables still in loose condition that is arranged as shown by the dotted line B.

It is to be noted that at this moment the microswitch MS is actuated and that the latching solenoid 40 has its plunger has its plunger 39 "sucked in", owing to the action of the permanent magnet 40, and will stay in such a condition until an electric current pulse on the coil 42 release the plunger 39.

Figure 9:
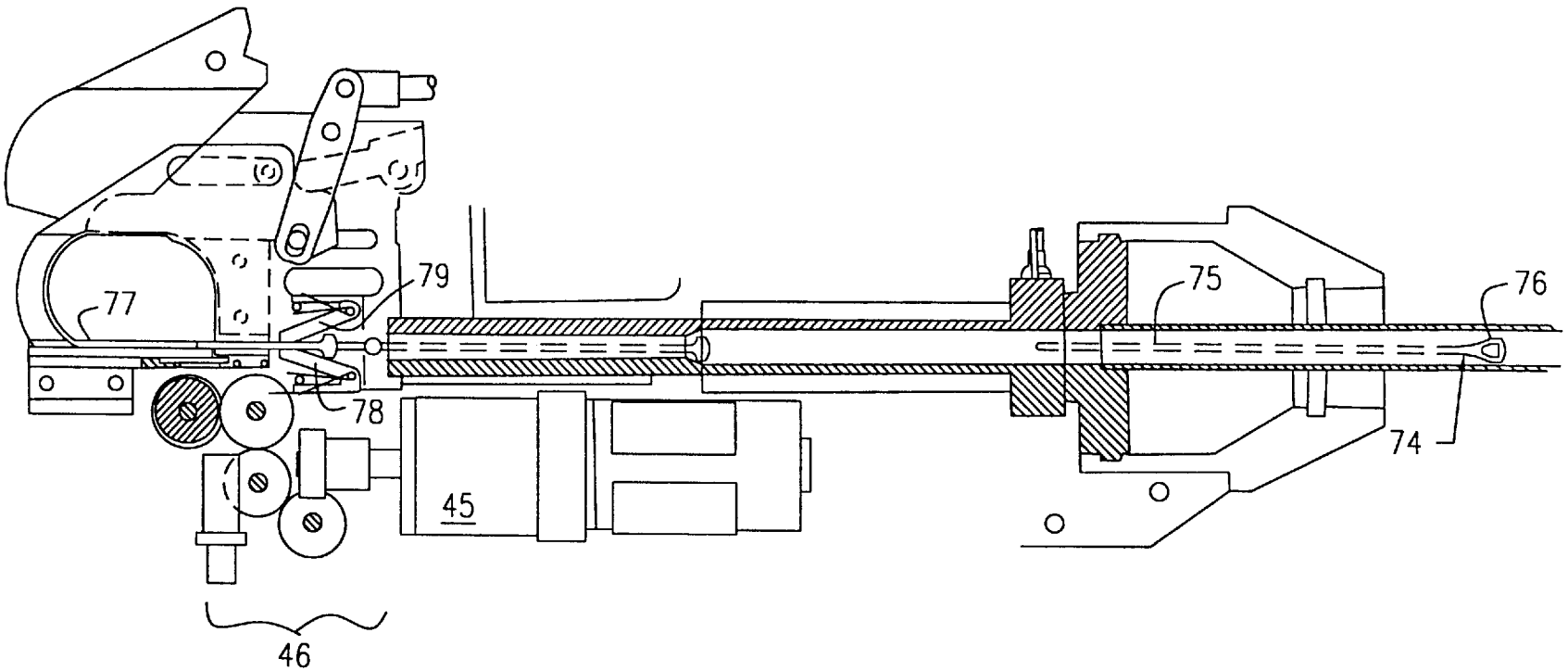

Let us refer also to FIG. 9.

The V-shaped, symmetrical members 56 and 57 are respectively pivoted in 63, 64 and the respective arms 65, 66 rest against stop pins 67, 68, respectively, urged by the hairpin springs 69, 70.

Other arms 71, 72 of the members 56 and 57 define a converging path ending in a gap 73 substantially corresponding to the thickness of the tail of a cable tie strap.

The inclination of the arms 71, 72, the opening of the gap 73, the return force of the hairpin springs 69, 70, the stiffness of the tail of the cable tie strap, the momentum (mass× velocity) of the tie strap propelled with compressed air, its longitudinal moment of inertia, are calculated so that a tie strap 74, having a tail 75 and a symmetrical apertured head 76 having a random orientation when propelled along the tubing 7 and the channels 58 and 59, will be axially oriented with a correct orientation: i.e., 0° or 180° with respect to the plane as defined by the gap 73.

Thus, as shown in FIG. 9, one of the opposed openings in the head 76 will be presented in a position to accept the tail 75, as will be described hereinafter.

The energy deriving from the momentum of the tie strap 74 will cause it to arrive at the position shown in 77 with a solid line, with its head 78 resting in the converging path defined by the members 56, 57, without the head 77 overcoming the force of the springs 69, 70.

Thus, before the head of the tie strap passes through elements 56 and 57, the force of springs 69, 70 operating on the latter fixes the elements in a "V" shape, which thus acts as a fixed mechanical stop.

In the travel thus far described up to the position shown with a solid line at the left of FIG. 9, the head 78 of the tie strap covers and uncovers the hole 79 associated to a conventional photoemitter/photocell pair (not shown), that provides to a controller a signal indicating that the tie strap is in the correct position as shown at the left of FIG. 9.

The signal provided by the photoemitter/photocell pair associated with the hole 79, triggers a sequence of power-driven automatic operations that lead to the binding of the cable tie strap around a bundle of cables and thus to the completing of an operation cycle of the tool in question.

Before discussing the sequence of power-driven automatic operations, other components of the automatic tie strap installation tool will be described.

As can be seen in the figures discussed so far, there is provided in the lower part of the automatic tool in question an electric motor 45 associated with a gear train 46.

This motor 45 is provided for the power-driven pulling of the tail of a tie strap after the passage through its apertured head for providing the binding force of the loop formed by the tail of the tie strap around a bundle of cables or the like.

Figure 11:
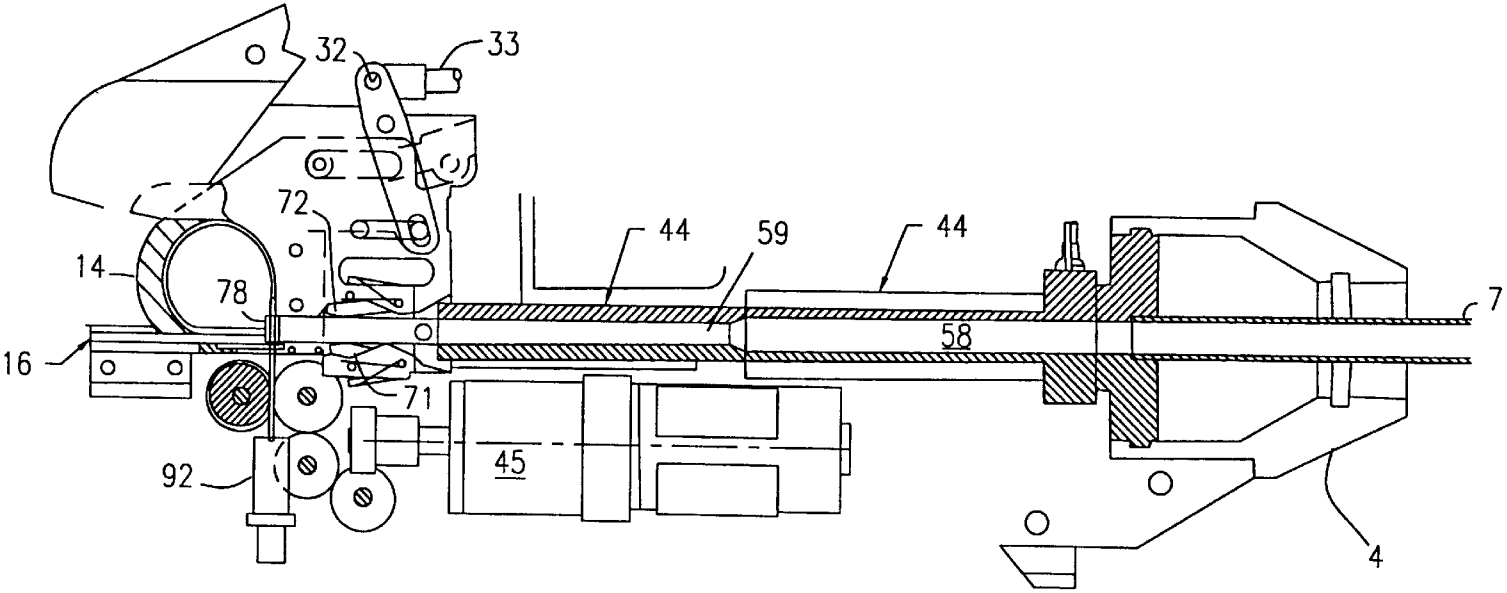
Figure 11A:
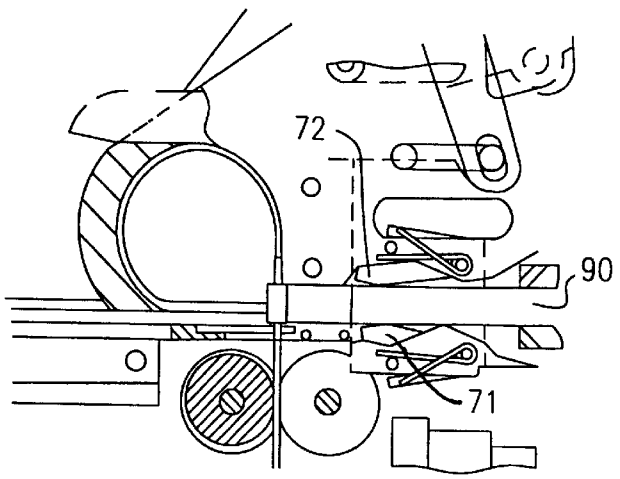

The electric motor 45 has mounted on its shaft 80*a* gear 81 with helical teeth that meshes under 90° with a similar gear 82 with helical teeth. As it will be clear this constitutes a 90° transmission. The gear 82 meshes with an idle gear 83 that drives a toothed wheel 84 that cooperates with an idle "anvil" wheel 85 provided with a pair of guiding disks 86 around its periphery. The nip between the teeth of the gear 84 and the wheel 85 grasps the tail of a tie strap partially passed through the apertured head of a tie strap for tightening the protrusion of the pusher rod 90 and a controller actuates the air cylinder 23 (see FIG. 3), which pushes the piston rod 33 to the left in the drawing causing the clockwise rotation of the rocker level 30 around it pivot 30*a*. Consequently the slot 31 of the rocker lever 30 is shifted at to the right in the drawing a and carries with it the pivoting pin 28 of the jaw 14. The pivoting pin 28 slides along the slot 29 and the jaw 14 is shifted to the right (FIGS. 11, 11A) thus reducing the closed path where the tie strap 77 lies. The tie strap 77 then slides along the channel formed in the jaw 14 and the rail 16 causing the extreme end of the tail 91 to enter into the apertured head 78, engaging the retain pawl housed in the head 78 and causing the tail 91 to engage the counter-rotating wheels 84, 85 while guided by the rim wheels 86.

Figure 12:
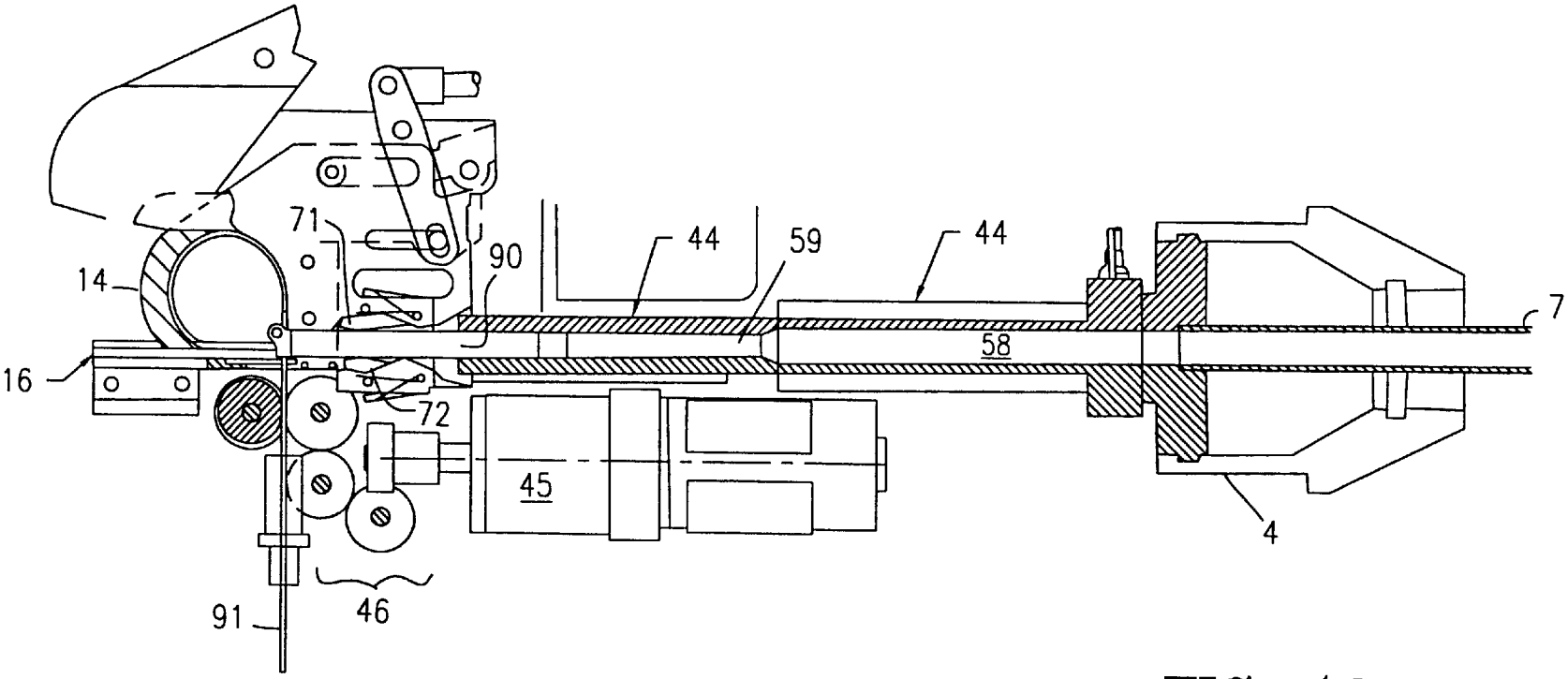

When the bundle of cables is squeezed as shown in FIG. 12, the electric motor 45, that is preferably a DC motor fed under a constant voltage power supply, tends to become stalled and consequently its current drain increases. The increase of the current drain of the motor 45 is in direct relationship to the torque delivered to the wheels 84, 85 and, assuming that no slip occurs between the wheels 84, 85 and the tail 91 of the tie strap, also correlated with the pull on the tail 91 and correspondingly the binding force of the tie strap on the bundle of cables. A current sensor in series with the motor 45 will be able to drive a trigger circuit well known in the art to cut the power supply to the motor 24, stopping its operation.

At this stage, the air cylinder contained in the sub-assembly 44 is actuated in reverse, shifting to the right the carriage 88 carrying the blade 89 for cutting the excess part of the tail 91 which protrudes from the head 78 of the tie strap, and the cut part falls down the conduit 91 for its expansion out of the installation tool.

With reference now to FIGS. 13 to 17, we will disclose in detail the structure and operation of the sub-assembly 44 mentioned in the above disclosure.

The sub-assembly 44 comprises a first block 93 and a second block 94. The first block 93 comprises a double action air cylinder 95 with a piston rod 96. Block 93 comprises a channel 58 (see FIG. 7)and block 94 comprises a channel 59 (see FIG. 7).

The part 94 comprises a block 97 made up of two symmetrical shells 98, 99 each having an S-shaped slot 100, 101 along which slides a pin 102 driven by a fork-like member 103 carried by the piston rod 96.

Figure 10:
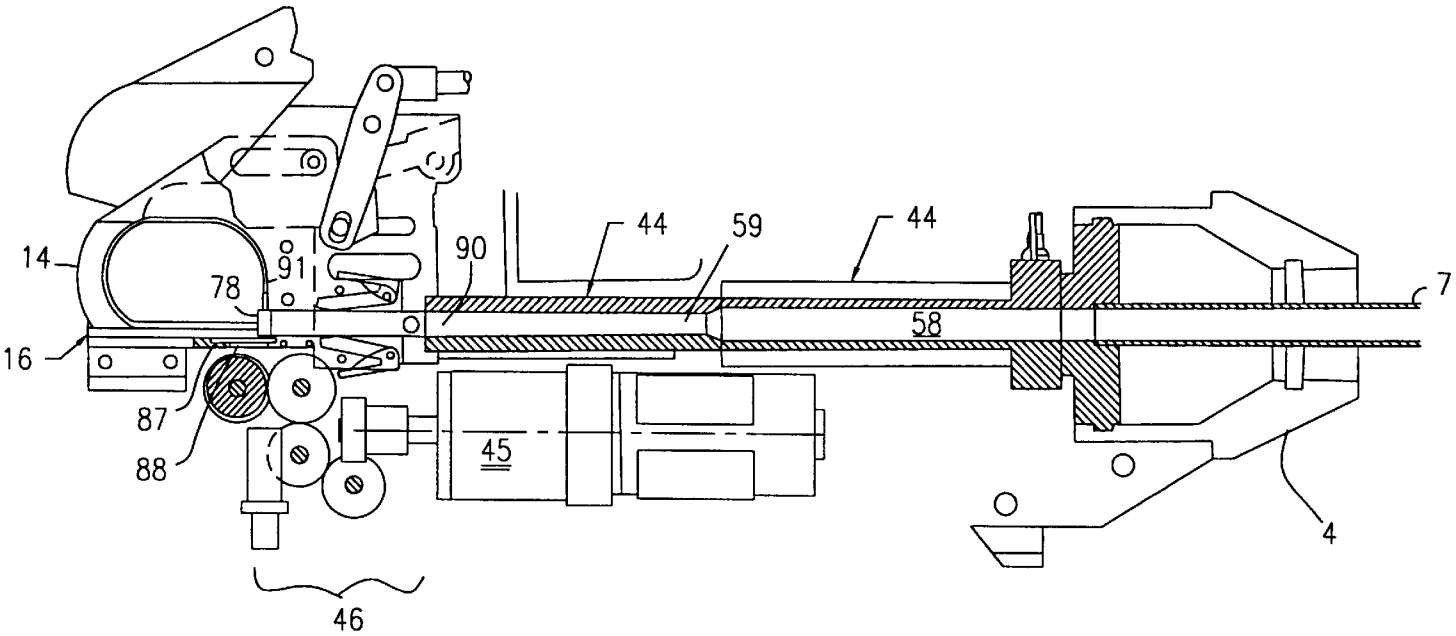
Figure 10A:
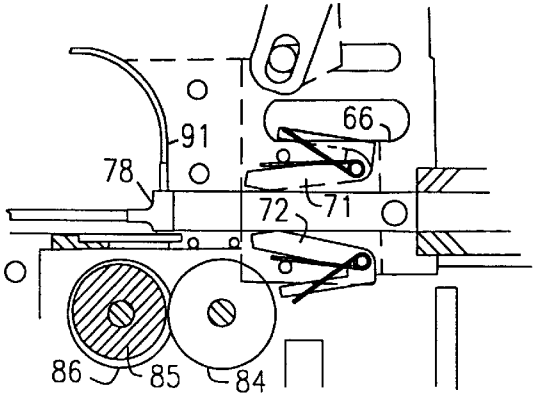
FIGS. 10A and 11A show enlarged representations of significant parts shown in FIGS. 10 and 11.

Pin 102 is in engagement with a tongue 104 having a hole 105 (see FIGS. 16 and 17) carried by the pusher rod 90 (see FIG. 10). The end of pusher rod 90 carries at its end opposite to the tongue 104 a projection 105 that engages a spring-shaped deflector 106 that helps to align the pusher rod 90 along the center line 107 from its rest position shown in FIG. 15A, in order to engage the head 78 of a tie strap 77 when the piston rod 96 is shifted to the left (FIGS. 15A to 15C) upon actuation of the air cylinder 95, to bring into position a tie strap (see FIGS. 7 to 12).

Pin 102, which protrudes below the shell 99 (FIG. 14) is arranged to engage the projections 108, 109 of the carriage 87 that holds a blade 88. The mechanical coupling between pin 102 and the projections 108, 109 of the carriage 87 constitutes a "lost motion" coupling for actuating the blade 88 at the end of a machine cycle for severing the excess part of a tied tie strap as described above.

Figure 15A:
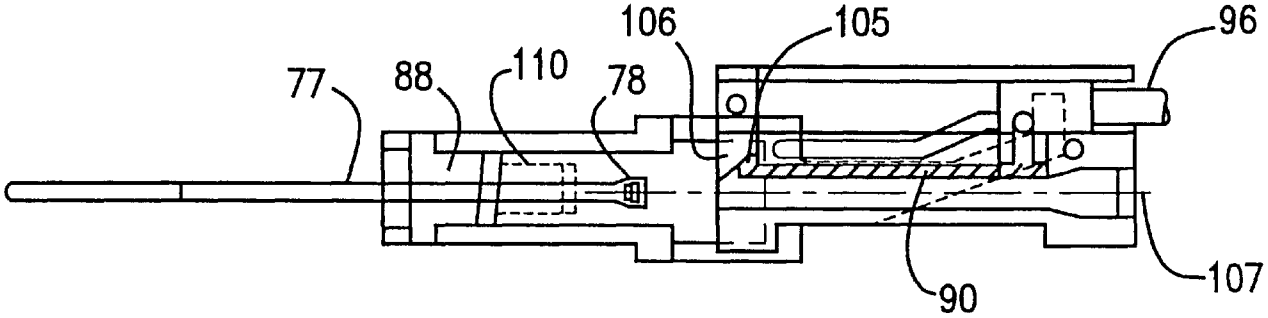
FIGS. 15A, 15B, and 15C show a schematic representation of an operating sequence for the pats of the sub-assembly of FIG. 12.
Figure 15B:
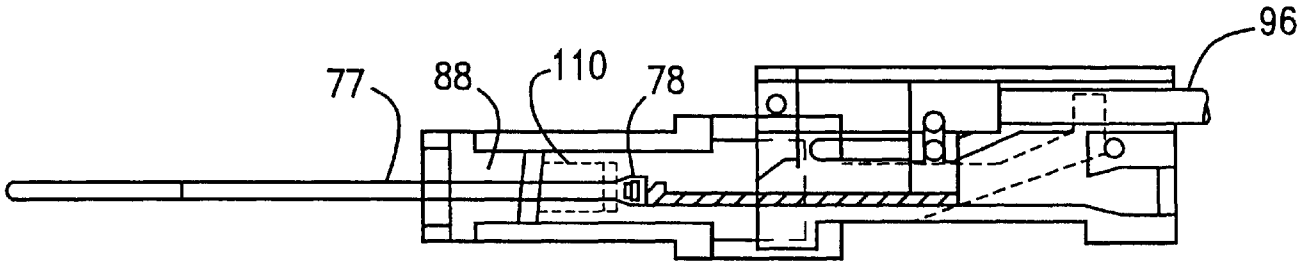
Figure 15C:
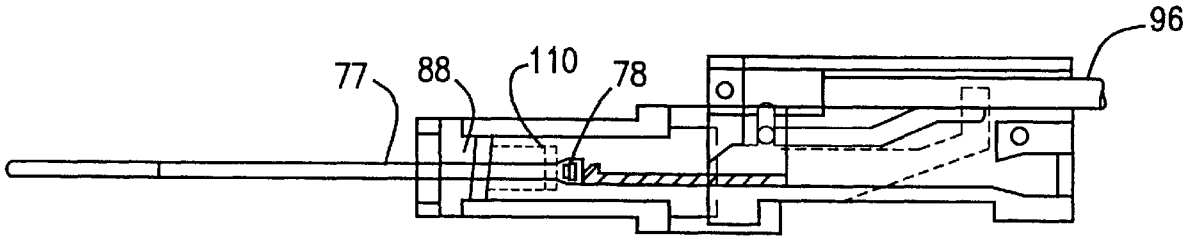
Figure 16:
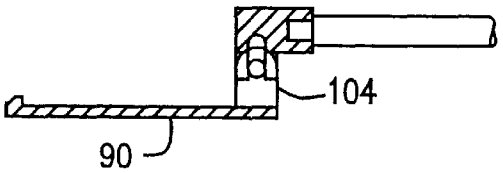
FIGS. 16 and 17 show details of parts of the sub-assembly of FIG. 13.
Figure 17:
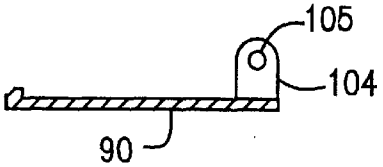

It is clear that the operation of sub-assembly 44 is analogous to the operation of the breech-block of automatic firearms, as it can be appreciated by inspecting the sequence of operations as shown in FIGS. 15A, 15B, and 15C. A detailed discussion of the operation of the mechanism shown in FIGS. 13 to 17 is omitted because it is considered within the grasp of a person skilled in the operation of mechanisms of this kind.

With references to FIGS. 15A, 15B, and 15C, it is to be noted, for a better understanding, that the dotted outline 110 is a phantom representation of the tie strap orientation means 71, 72 best shown in FIGS. 7 to 12.

Figure 18:
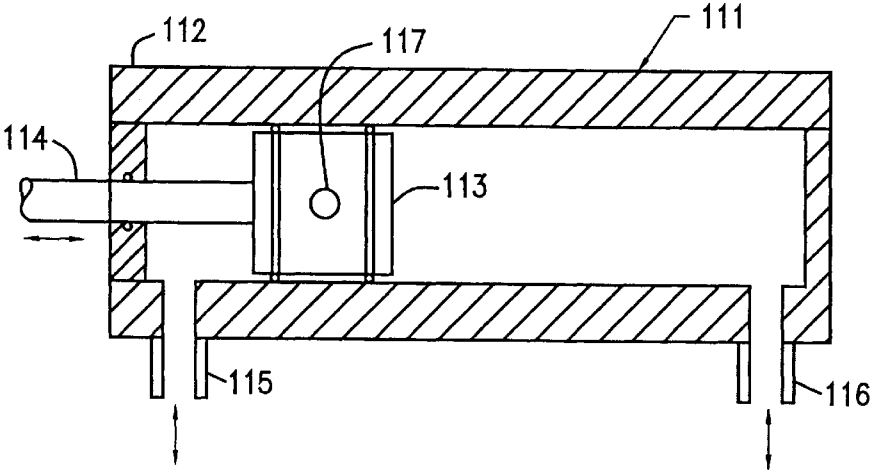
FIGS. 18 and 19 show schematically a position-sensing structure for the air cylinders that power the automatic installation tool.
Figure 19:
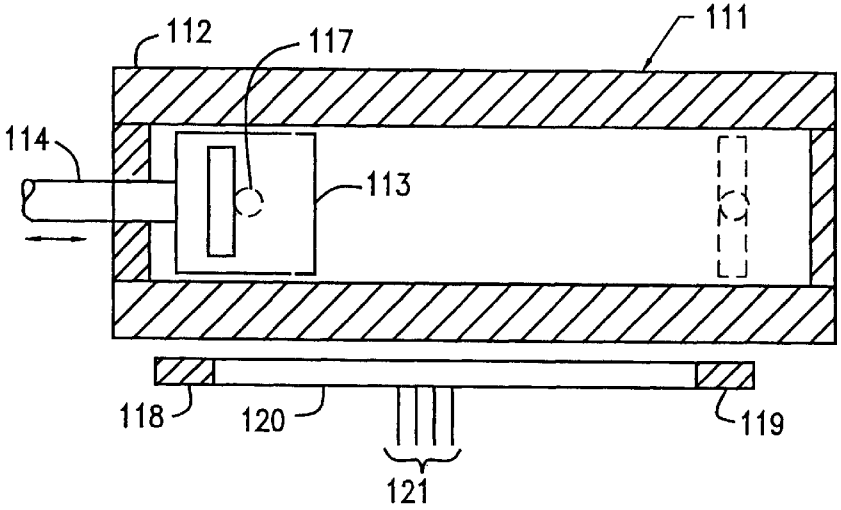

Now, with reference to FIGS. 18 and 19 a position sensing arrangement for the air cylinders that power the automatic installation tool according to the invention will be illustrated.

The sensing of the position of the pistons at the interior of the air cylinders previously mentioned is essential for two reasons:

Firstly, for providing signals for the several "breakpoints" in the sequence of operations for the installation, positioning, tying, etc., of a cable tie strap around a bundle of cables, and Secondly, for the correct initialization at the start-up of the whole apparatus, since it must be assumed that the various parts of the automatic installation tool are in a random positioning at the start-up of the machine.

The schematic representations shown in FIGS. 18 and 19 are valid both for the air cylinder powering the jaw 14 and the air cylinder powering the sub-assembly 44.

FIGS. 18 and 19 are longitudinal sectional views taken at 90° from each other. The air cylinder 111, comprises a housing 112 where a piston 113 can slide, which is connected to a piston rod 114. The piston 113 can be driven to the right or to the left with respect to FIGS. 18 and 19, according to whether compressed air is applied to the ports 115 or 116, respectively, by means of electrovalves (not shown) that are driven by a controller unit (not shown).

Within the piston 113 is located a permanent magnet 117, which produces a magnetic field extending outside the housing 112. The lines of force of the magnetic field produced by the magnet 117 influence a magnetic sensor either 118 or 119 contained in a sub-assembly 120. The magnetic sensor preferably is a Hall sensor or a magnetic field sensitive transistor well known in the art, that produces a signal on the pins 121 when the magnet 117 is in register with either the sensor 118 or 119. The signals available on the pins 121 are fed to a controller that provides both the initialization of the conditions of the automatic tool at the power-on and the correct sequencing of activation as described above.

Turning back to FIG. 1, it can be noted that on the top of the tool there is provided a push button 12 that is arranged to actuate a microswitch (not shown) for enabling repeated operations of the automatic installation tool for applying tie straps in sequence without the need for opening the jaw 14.

The microswitch associated to push-button 12 operates on a controller associated to the apparatus in such a way that as long as the trigger 10 is maintained actuated a new tie strap is fed to the installation tool from a dispenser thereof, and tied to the bundle of cables or the like for each actuation of the push-button 12.

Figure 20A:
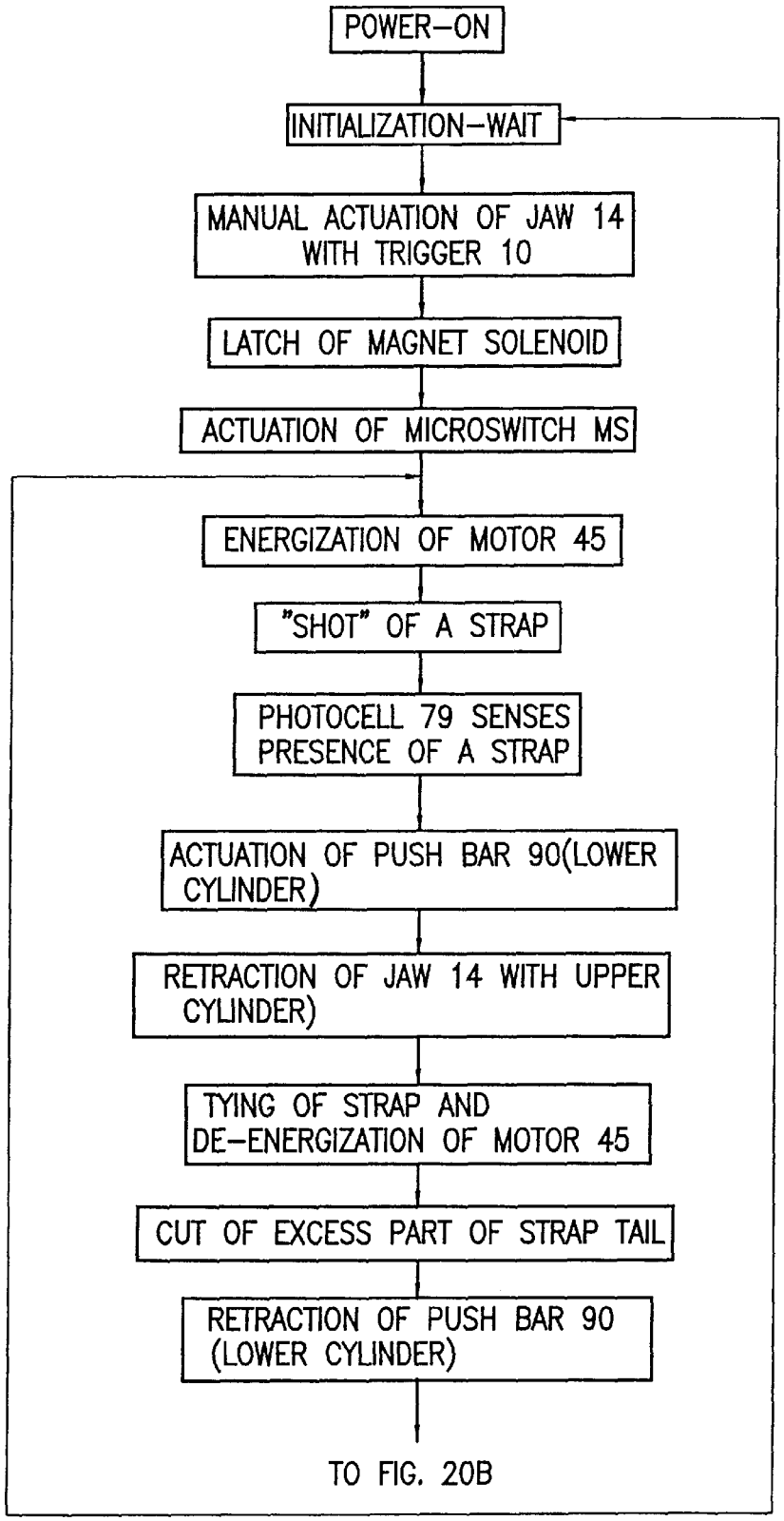
FIGS. 20A and 20B taken together show a simplified flow chart of the operation of the automatic tool.
Figure 20B:
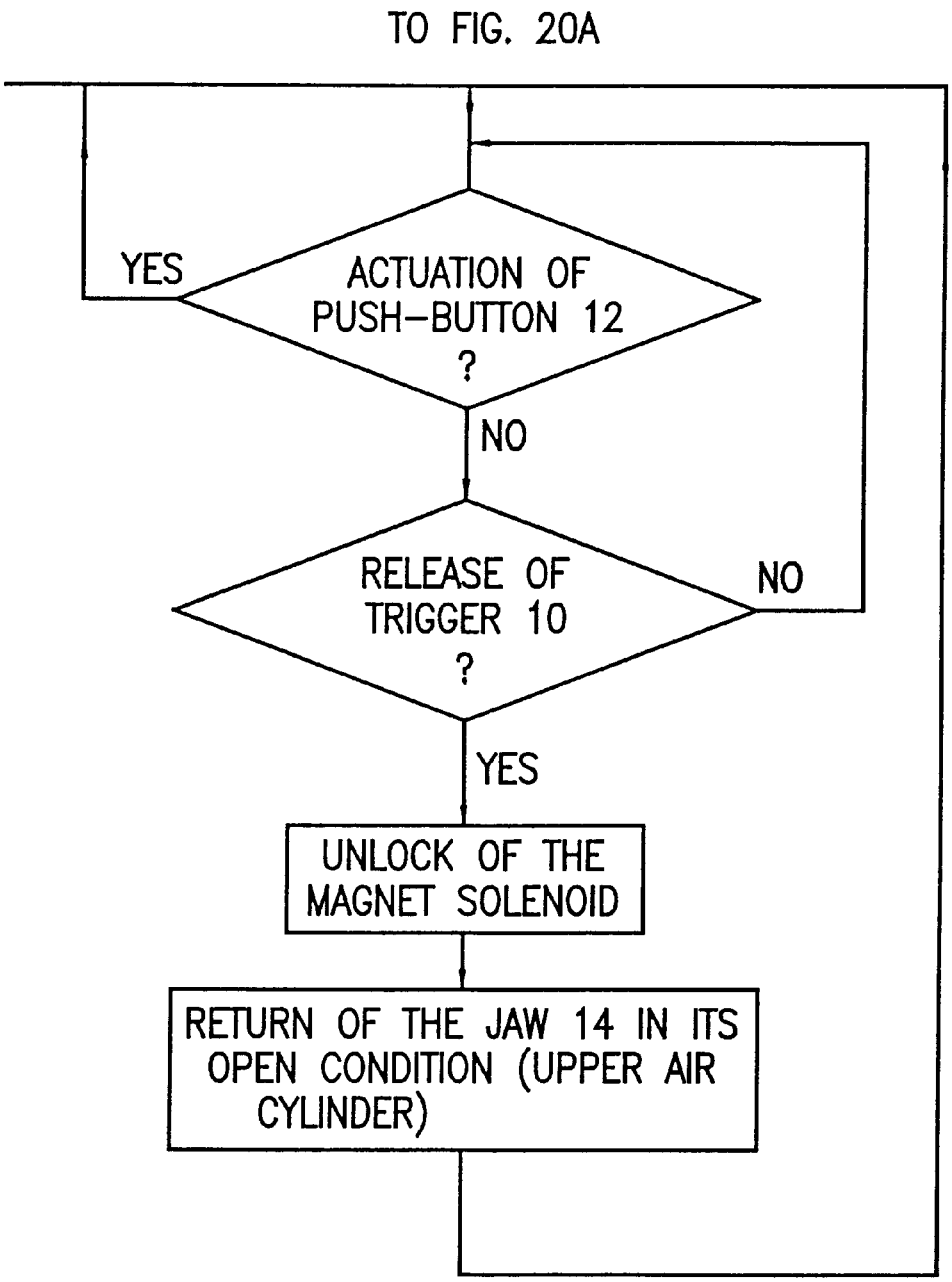

This mode of operation can be better understood with reference to FIGS. 20A, 20B that show a simplified flow-chart diagram of the operation of the automatic tool according to the invention.

It is though that FIGS. 20A, 20B are sufficiently self-explanatory in view of the foregoing disclosure and consequently will not be discussed in detail.

Now, with references to FIGS. 21, 22, 23, 24 the sequence of actions that lead to a correct orientation of a cable tie strap shot in a random orientation from a dispenser (not shown) into the application tool will be discussed.

Figure 25:
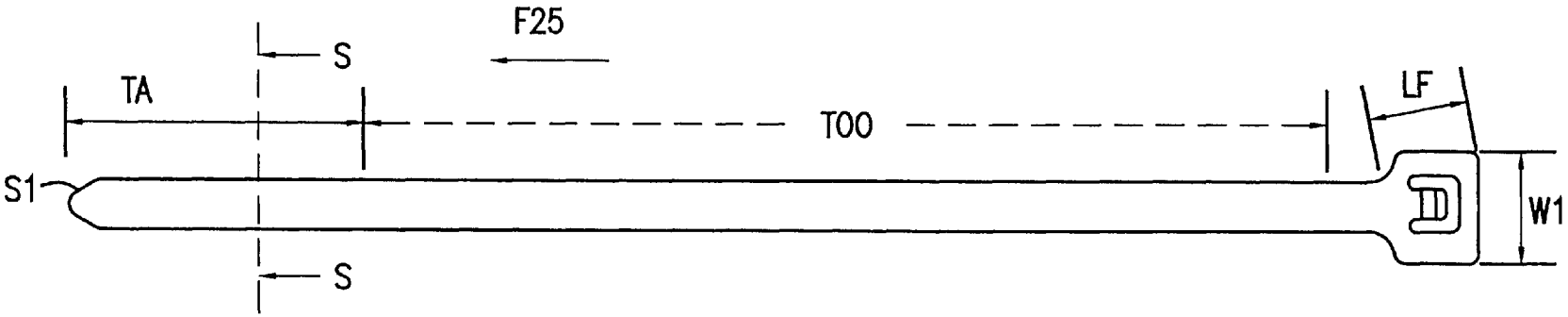
FIGS. 25 and 26 show schematically two views, set at 90° with respect to each other, of a typical symmetrical cable tie that can be used with the tool according to the present invention.
Figure 26:
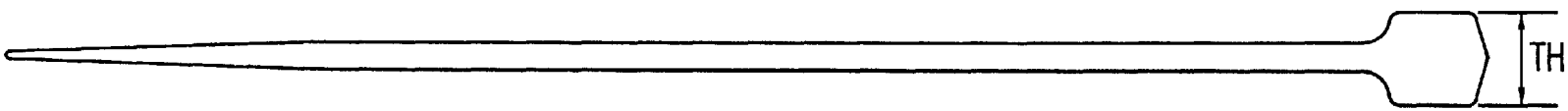

Reference should also be made to FIGS. 25 and 26, that show schematically a typical symmetrical tie strap in plan view and lateral view, respectively, as well as to FIG. 9, that shows schematically the propulsion of a cable tie strap within the application tool.

As already said, (FIGS. 25 and 26) a cable tie strap for use in the application tool includes a tail part TA, a toothed body TOO and an apertured head having a length LE, a width WI and a thickness THP. As stated above the cable tie strap is propelled into the application tool in the condition tail-first, head-last.

Reference should now be made to FIGS. 21 to 24, that are a partial schematic view looking into the conduit 59, the internal contour of which is shown in 200, and where a part of the members 71, 72 is shown, together with the gap 73.

The tail TA (FIGS. 25, 26) is shown in cross-section substantially along plane S—S of FIG. 25.

As can be appreciated from FIG. 9, practically the members 71, 72 and the gap 73 constitute something to a flattened funnel. The internal walls of the member 71, 72 are inclined towards the gap 73.

The tie strap during its travel towards the gap 73 is oriented along its longitudinal axis at random, i.e., the plane defined by the broad part of the body of the tie strap may assume any angle between 0° and 360° (practically 0° and 180°) considering the symmetry of the tie strap with respect to a reference plane R defined by the opening of the gap 73.

Four situations can arise when the tail TA of the tie strap arrives against the members 71, 72.

Figure 21:
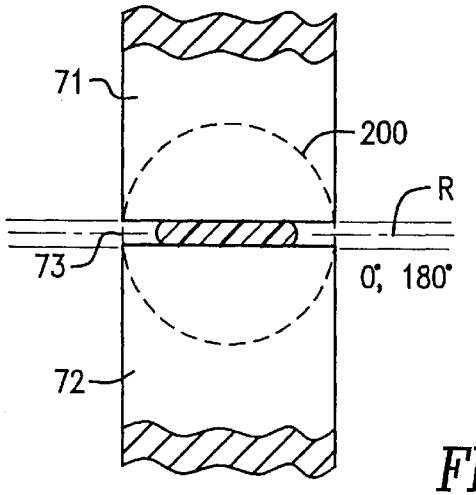
FIGS. 21, 22, 23, and 24 show a sequence of actions that lead to correct orientation of a cable tie that is "shot" into the installation tool with a random orientation.

A) FIG. 21: by chance the cable tie strap shot at random is correctly aligned (0°, 180°) with respect to the plane R and therefore it will simply enter into the gap 73 starting the previously discussed sequence of operations.

Figure 22:
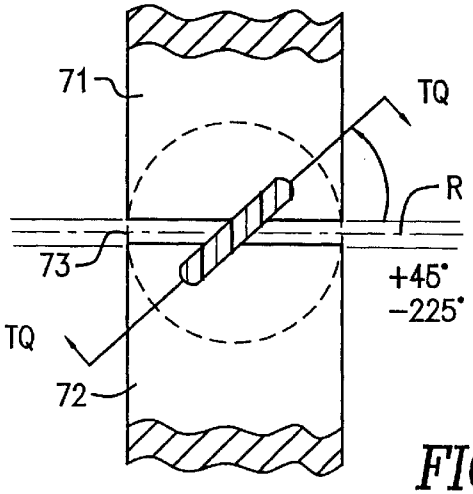

B) FIG. 22: the cable tie strap arrives at an angle, say +45° or −225° with respect to the plane R. The edges E1, E2 (FIG. 25) will hit the angled walls of the members 71, 72. The tie strap arrives in the position shown in FIG. 22 at high speed and with non zero contents of energy (E=½ m v squared) where m is the mass of the tie strap and v is its speed.

The impingement of the tail of the tie strap will make use of such energy to develop a torque TQ that twists the tail of the strap in a clockwise direction to make it enter into the gap 73 and henceforth the situation will be the same as discussed under A).

Figure 23:
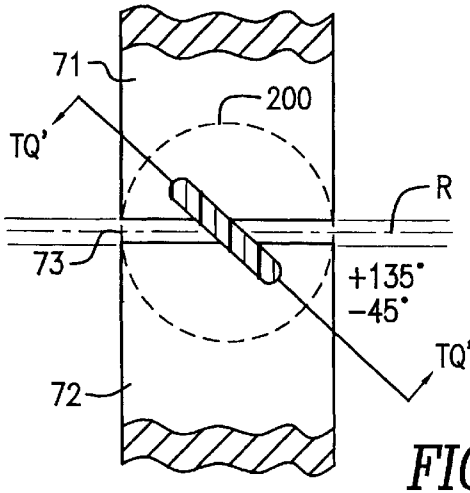

FIG. 23: the cable tie strap arrives at an angle, say, +135° or −45° with respect to the reference plane R.

A situation opposite to the one discussed under B) will occur, with the development of a counterclockwise torque TQ', and henceforth the situation will again be the one discussed under A).

Figure 24:
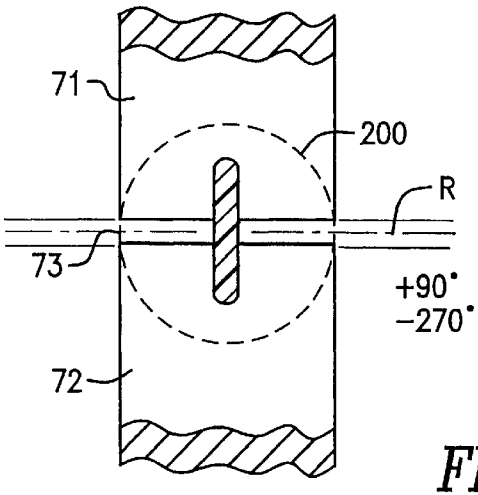

D) FIG. 24: this is a limit case, where the tail is oriented exactly at +90°, −270° with respect to the reference plane R. This is clearly an unstable situation. Any disturbance (vibrations, irregularities of shape of the tail TA, etc.) Will cause the situation to fall into the conditions discussed under B) or C).

The means and methods described here for orientation of a cable tie that is "shot" with a random orientation into the intake channel of an installation tool according to the present invention is particularly important, as a cable tie strap distributor separate from the apparatus according to the present invention can be connected to the application tool by means of a pipe with a substantially circular internal cross-section, unlike the case of tools known to the art, which require the use of a pipe with a section equivalent to the shape of the tie strap when viewed head-on, in order to ensure that said tie strap reaches the installation tool with the correct orientation and to enable its tail to be correctly inserted into the apertured head of the tie strap. The absence of a pipe with a specific section makes it possible to avoid blockage during travel of the cable tie strap from the distributor to the application tool, and also allows the speed of travel of the cable tie strap between the distributor and the application tool to be increased, as the cable tie strap as it travels is practically floating on the compressed air that pushes it along the pipe connecting the distributor to the application tool.

Figure 27:
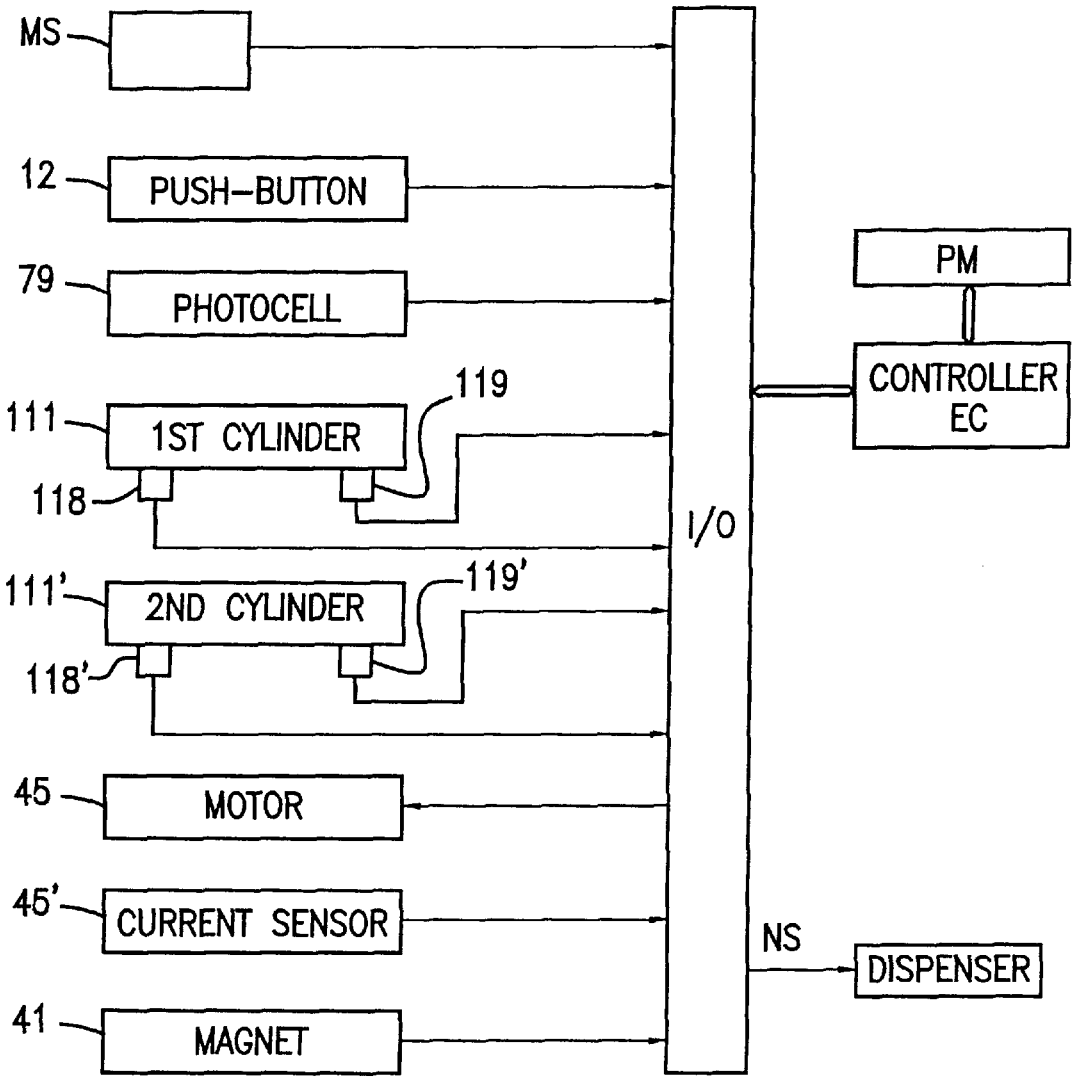
FIG. 27 shows schematically the interconnection of various elements of the tool with an electronic control unit.

FIG. 27 schematically shows the circuits connecting various elements in the installation tool described above with an electronic control unit outside the tool itself, to which reference is made for the purposes of completeness of description.

The electronic control unit EC is associated to a memory PM containing the tool operation management program described above. The control unit EC is associated to an input/output group I/O which receives signals from various components and which sends out signals and commands as will be illustrated in the following.

The input/output unit 1/0 receives an electric signal from the microswitch MS: from button 12 enabling repeated cable tie application operations; from the photocell 79 detecting the presence of a cable tie in the closed path within the application tool, from the sensors 118 and 119 connected to the dual-effect cylinder 11; and from the sensors 118', 119' on the dual-effect cylinder 111', which activate the retraction of the movable jaw 14 and activation of the mechanisms associated to the block 44, respectively. The numeral 45 indicates the electric motor, which provides for locking of the cable tie strap, operation of which is controlled by a current sensor 45' which sends a signal to the electronic control unit EC to deactivate it when a pre-set locking force has been reached. Furthermore, a signal is sent by the input/output unit I/O to the permanent electromagnet magnet 41 to deactivate it and this allow opening of the jaw 14, after release of the trigger 10, at the end of the cable tie strap installation and binding operation or operations.

Another signal NS is also sent from the I/O unit, to signal to a cable tie strap distributor, which is not shown because it does not form a part of the present invention, that another cable tie strap must be delivered ready for manipulation by the tool according to the present invention.

It will be noted from the preceding description that an automatic tool has been provided for installation of cable tie straps, that allows high-speed operation, gives a notable guarantee of safety, both from the mechanical cable tie strap installation point of view and from the point of view of operator safety, and which furthermore enables repeated installation operations to be carried out without having to make the jaws that grip the bundle of cables or the like perform a full open and close cycle every time.

It should further be noted that, even though the present invention has been described with particular reference to symmetrical type cable tie straps, it might also be used, with modifications that are will within the ability of an expert in this field, with conventional cable tie straps that have a symmetrical apertured head and a stop pawl.

The present invention has been described with reference to a currently preferred embodiment thereof, but it is understood that alterations and modifications can be made thereto by a person skilled in the art without departing from the scope of protection.

What is claimed is:

1. An automatic cable tie installation tool, comprising:

a frame with a handle with manual trigger means;

a movable jaw for grasping a bundle of cables or the like to be tied with a tie strap;

means interconnecting said trigger means and said jaw, for moving the jaw in engagement with said bundle of cables;

first means that can be actuated at the end of said engagement operation for retracting said jaw to define a substantially closed path for a cable tie;

means for shooting an elongate cable tie having a random orientation along a longitudinal axis towards said closed path, associated with means for braking and correctly orienting said cable tie strap before entering of the same into said closed path;

second means for pushing said cable tie along said closed path and for engaging the tail of the cable tie strap into an apertured head of the cable ties strap;

third means for grasping the tail of the cable tie strap after the passage thereof through said apertured head so that the cable tie is tightened around the bundle of cables or the like;

means cooperating with said third means, to sense when a desired tightening of the cable tie strap has been reached, and to actuate said second means to drive cutting means for severing the excess of said tail of said cable tie strap protruding from the exit side of said apertured head; and means for returning said first means to its rest condition in order to open and release said jaw and to reposition said second means in its rest position, ready for a new operation.

2. An automatic cable tie installation tool according to claim 1, characterized in that said movable jaw is provided with an end, and is arranged to perform a first arcuate movement under the action of said manual trigger means to engage with said end a rail piece at the end of said arcuate movement after having engaged a bundle of wires or cables.

3. An automatic cable tie installation tool according to claim 2, characterized in that said manual trigger means and said movable jaw are interconnected with mechanical interconnection means arranged so that the arcuate movement of said jaw entails a swing motion having an extension greater than the travel motion of said trigger means, whereby the force developed at the movable end of said jaw is smaller than the force applied to said manual trigger means.

4. An automatic cable tie installation tool according to claim 2 characterized in that the arcuate movement of said movable jaw up to when the end of said jaw engages said rail piece is performed solely with the force of a finger of an operator.

5. An automatic cable tie installation tool according to claim 4, characterized in that said mechanical interconnection means comprise a lever having a cam member at one end arranged to actuate said first means for retracting said jaw to define a substantially closed path for a cable tie.

6. An automatic cable tie installation tool according to claim 5, characterized in that said cam member is arranged for actuating a microswitch for providing a signal for starting automatic installation operations.

7. An automatic cable tie installation tool according to claim 1, characterized in that said first means for retracting said jaw to define a substantially closed path for a cable tie comprise a double action fluid powered cylinder; a first action of said air powered cylinder being started by the closure of said microswitch.

8. An automatic cable tie installation tool according to claim 1, characterized in that said substantially closed path for the cable tie strap is restricted in extension with respect to the closed path defined after the closure of said jaw by means of said trigger.

9. An automatic cable tie installation tool according to claim 1, characterized in that said shooting means for shooting a cable tie having a random orientation towards said closed path comprise a conduit wherein a cable tie strap is propelled by means of a compressed fluid from a dispenser external to said tool, and said cable tie strap is propelled into the tool in a position tail-first, head-last without a predetermined orientation along its longitudinal axis with reference to a plane defined by said closed path defined by said jaw and said rail; said shooting means being operatively coupled to means for correctly orienting and braking said propelled tie strap which include a funnel-like structure having an aperture constituted by a flat gap defining a plane corresponding to the plane defined by said jaw and rail.

10. An automatic cable tie installation tool according to claim 9, characterized in that said means for correctly orienting and braking said propelled tie strap include a pair of V-shaped members elastically biased one towards the other and defining at one end said gap and at the other end a converging channel.

11. An automatic cable tie installation tool according to claim 10, characterized in that said gap is aligned with said closed path for a cable tie strap.

12. An automatic cable tie installation tool according to claim 11, characterized in that said second means for pushing said cable tie along said closed path and for causing the engagement of the tail of the tie strap into the apertured head of a tie strap include a pushing rod actuated by a fluid pressure double action cylinder; there being provided guide means for displacing said pushing rod to enter into said converging channel constituted by said pair of V-shaped elastically biased members so that an end of the pushing rod engages the head of a tie strap pushing it along said closed path while opening said gap overcoming the bias applied to said V-shaped members, causing the passage of the tail of a cable tie through the apertured head of the cable tie so that a part of the tail protrudes beyond said apertured head.

13. An automatic cable tie installation tool, according to claim 12, characterized in that said third means for grasping and pulling the tail of the cable tie comprise a pair of wheels driven in rotation by means of an electric motor, so that the tie strap is tightened around the bundle of cables or the like.

14. An automatic cable tie installation tool according to claim 13, characterized in that means are provided for sensing the torque developed by said electric motor during the tightening of a tie strap around a bundle of cables or the like, said means being arranged to cut the energization of said motor when a predetermined torque has been reached.

15. An automatic cable tie installation tool, according to claim 14, characterized in that means are provided for actuating in reverse said fluid pressure double action cylinder operatively connected to said pushing rod when said electric motor is de-energized; said cylinder being arranged, when actuated in reverse, to drive cutting means for severing the excess of said tail of the cable tie.

16. An automatic cable tie installation tool according to claim 15, characterized in that said cutting means are supported by a carriage coupled by a lost-motion coupling with said fluid pressure cylinder, the arrangement being such that during a forward stroke of said cylinder said carriage is displaced to shift said cutting means out of the path of said tail, and when driven in reverse said carriage is displaced to perform a cutting action on said excess tail.

17. An automatic cable tie installation tool according to claim 10, characterized in that a cylinder constituting the first means actuated for retracting said jaw is actuated in reverse after the cutting operation for advancing said jaw.

18. An automatic cable tie installation tool according to claim 17, characterized in that said means interconnecting said trigger and said jaw are arranged so that upon release of said trigger after the actuation in reverse of said cylinder, the operation of the tool is stopped, and said jaw is opened, ready for a new cycle.

19. An automatic cable tie installation tool according to claim 18, characterized in that additional manual control means are provided for repeating all the operations of installation of cable tie straps upon actuation of said additional manual control means for as long as said trigger means are maintained actuated by the finger of an operator.

20. An automatic cable tie installation tool according to claim 19 characterized in that a latching solenoid is provided for maintaining in the operative condition the means controlled by said trigger means both during a single cycle operation and during a multiple cycle operation.

21. An automatic cable tie installation tool according to claim 20, characterized in that said cable tie with apertured head is a symmetrical one capable of being operated in either 0° or 180° orientation around its longitudinal axis with respect to a plane defined by said gap and said path defined by said jaw and said rail.

22. An automatic cable tie installation tool according to claim 21, characterized in that said cable tie strap is propelled tail-first, head-last and with a random orientation with respect to its longitudinal axis by a flow of compressed fluid from a dispenser apparatus into said tool.

23. An automatic cable tie installation tool according to claim 22, characterized in that said V-shaped elastically biased members and said gap are arranged substantially as a flattened funnel whereby when said cable tie strap is shot therein in the condition tail-first, head-last with random orientation, the impingement of the tip of the tail with the inclined parts of said V-shaped members producing an orienting torque with reference to the longitudinal axis of the tie strap, whereby the same is correctly oriented with respect to said gap and consequently with respect to said closed path to be followed by the tie strap in the tightening operation.

* * * * *